US007481520B2

(12) United States Patent
Takei

(10) Patent No.: US 7,481,520 B2
(45) Date of Patent: Jan. 27, 2009

(54) LIQUID CARTRIDGE, PRINTER, AND METHOD FOR CONTROLLING A PRINTER WITH A LIQUID CARTRIDGE HAVING INTEGRATED WASTE STORAGE AND MEMORY

(75) Inventor: Toshiki Takei, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 371 days.

(21) Appl. No.: 11/039,083

(22) Filed: Jan. 21, 2005

(65) Prior Publication Data

US 2005/0185035 A1 Aug. 25, 2005

(30) Foreign Application Priority Data

Jan. 21, 2004 (JP) ..... P2004-013206
Jan. 26, 2004 (JP) ..... P2004-017253

(51) Int. Cl.
*B41J 2/175* (2006.01)
*B41J 2/165* (2006.01)

(52) U.S. Cl. ..... 347/86; 347/36; 347/85

(58) Field of Classification Search ..... 347/86, 347/36, 19, 10, 7, 85
See application file for complete search history.

(56) References Cited

U.S. PATENT DOCUMENTS 6,203,138 B1 * 3/2001 Hirabayashi et al. ..... 347/36
6,357,854 B1 * 3/2002 Igval et al. ..... 347/36
6,361,138 B1 * 3/2002 Seino et al. ..... 347/19
6,378,997 B1 * 4/2002 Nitta ..... 347/85
6,585,345 B2 7/2003 Kosugi
6,672,695 B1 1/2004 Naka et al.
6,976,746 B2 * 12/2005 Shimamura ..... 347/7
7,014,305 B2 * 3/2006 Matsumoto et al. ..... 347/86
7,052,121 B2 * 5/2006 Yamada ..... 347/86
2001/0040613 A1 * 11/2001 Nakazawa et al. ..... 347/86
2003/0016257 A1 * 1/2003 Asauchi et al. ..... 347/10
2003/0160839 A1 8/2003 Kosugi
2003/0174181 A1 * 9/2003 Nishioka et al. ..... 347/7
2004/0046821 A1 * 3/2004 Kosugi ..... 347/19
2004/0075712 A1 * 4/2004 Ono ..... 347/36

FOREIGN PATENT DOCUMENTS

EP 0 999 063 5/2000
EP 1 213 148 6/2002
JP 9-90753 4/1997
JP 10-39692 2/1998

(Continued)

OTHER PUBLICATIONS

Patent Abstract of Japan, vol. 2000, No. 20, Jul. 10, 2001 and Japan 2001 071533 A (Seiko Epson Corp.).

*Primary Examiner*—Stephen D Meier
*Assistant Examiner*—Carlos A Martinez, Jr.
(74) *Attorney, Agent, or Firm*—Nixon & Vanderhye P.C.

(57) ABSTRACT

A liquid cartridge includes an ink cartridge having a first housing portion for containing a liquid and a waste liquid storage cartridge having a second housing portion for containing a waste liquid, and a rewritable nonvolatile storage portion which stores a first threshold, a second threshold, liquid amount information and waste liquid amount information. The first threshold indicates a near liquid end state in which the liquid in the first housing portion is near to end. The second threshold indicates a near full state in which the waste liquid in the second housing portion is near to full. The liquid amount information indicates a liquid amount of the liquid contained in the first housing portion. The waste liquid amount information indicates a waste liquid amount of the waste liquid contained in the second housing portion. The ink cartridge and the waste liquid cartridge are integrally formed.

16 Claims, 12 Drawing Sheets

FOREIGN PATENT DOCUMENTS

| | | |
|---|---|---|
| JP | 2001-71533 | 3/2001 |
| JP | 2001-199081 | 7/2001 |
| JP | 2002-029065 | 1/2002 |
| JP | 2002-178540 | 6/2002 |
| JP | 2002-214984 | 7/2002 |
| JP | 2002-234192 | 8/2002 |
| JP | 2002-244438 | 8/2002 |
| JP | 2003-114571 | 4/2003 |
| JP | 2003-154734 | 5/2003 |
| JP | 2003-266747 | 9/2003 |
| WO | WO 90/00974 | 2/1990 |
| WO | WO 96/04141 | 2/1996 |

* cited by examiner

LIQUID CARTRIDGE, PRINTER, AND METHOD FOR CONTROLLING A PRINTER WITH A LIQUID CARTRIDGE HAVING INTEGRATED WASTE STORAGE AND MEMORY

BACKGROUND OF THE INVENTION

The present invention relates to a liquid cartridge including an electrical rewritable storage portion, a printer, and a method for controlling the printer.

In a printer of an ink jet type which serves to eject an ink (liquid) in a droplet condition from a head to a recording medium for printing, information about the amount of the ink stored in a removable ink cartridge (liquid cartridge) for storing the ink to be supplied to the head is stored in the storage portion (internal memory) of the ink cartridge. Moreover, information about a threshold indicating that the amount of the ink stored in the ink cartridge is almost zero is stored in a printer body.

According to JP-A-2001-199081, information about the amount of containment of an ink is stored in the storage portion of an ink cartridge. A printer reads information about the amount of containment of an ink from the storage portion and subtracts the amount of consumption of the ink by printing which is calculated by the printer from the read information, and updates the information about the amount of containment of an ink. The updated information is overwritten to the storage portion of the ink cartridge.

The printer includes the latest information about the amount of containment of the ink with information about a threshold indicating that the amount of the ink in the ink cartridge provided in the printer is almost zero, thereby deciding whether or not the amount of the ink in the ink cartridge is almost zero. When the amount of containment of the ink reaches the threshold, the printer displays that the amount of the ink is almost zero and notifies a warning to a user.

According to JP-A-2001-71533, moreover, a host device reads information from the storage portion of an ink cartridge and compares the read information with information about a threshold, thereby carrying out a decision in place of a printer.

In the related printer of an ink jet type, moreover, a head is held in a clean state and the maintenance of the head is executed at any time in such a manner that reliable printing can always be carried out. For the maintenance of the head, an ink is ejected from the head to a predetermined portion other than a printing medium or is forcibly sucked from the head, thereby preventing the head from being clogged or contaminated. The ink used for the maintenance is accommodated in a waste liquid storage cartridge (liquid cartridge).

According to JP-A-2002-29065, a waste liquid storage cartridge includes a storage portion. The storage portion stores a total amount obtained by adding the amount of an accommodated waste liquid at each time. A printer compares the total amount of the waste liquid with a threshold to be the amount of accommodation in the waste liquid storage cartridge possessed by the printer, and decides whether or not the waste liquid storage cartridge is filled up.

However, in any related technique with respect to an ink cartridge, for example, the internal memory of an ink cartridge simply stores, as a value, information about the amount of containment of an ink. In order to decide whether or not the amount of containment of the ink is almost zero from the information about the amount of containment of the ink, it is necessary to compare the information with a threshold possessed by a printer or a host device. For this reason, the printer or the host device is required to have, as basic information, information about the specifications of an attachable ink cartridge and a threshold for deciding that the amount of the residual ink is reduced. When an ink cartridge is newly added or the specifications such as the ink capacity of an existing ink cartridge are varied, furthermore, the program of the printer is to be changed and the amount of containment of the ink is to be correctly grasped corresponding to the variation in the specifications of the ink cartridge.

In the related technique with respect to the waste liquid storage cartridge, moreover, the storage portion of the waste liquid storage cartridge simply stores, as a value, the amount of containment of the accommodated waste liquid. In order to decide whether or not the waste liquid storage cartridge is almost filled up from the information about the amount of containment of the waste liquid, it is necessary to compare the information with the threshold possessed by the printer. For this reason, the printer is required to have, as basic information, a threshold indicative of the total amount of accommodation of the waste liquid and information about the specifications of the attachable waste liquid storage cartridge. When the waste liquid storage cartridge is newly added or the specifications such as the amount of accommodation of the existing waste liquid storage cartridge are varied, furthermore, the program of the printer is to be changed and the amount of accommodation of the waste liquid and a fill-up situation are to be correctly grasped corresponding to the variation in the specifications of the waste liquid storage cartridge.

Further, in a related ink cartridge including a waste liquid containing portion and an unused ink containing portion which are integrally formed each other, a volume of the waste liquid containing portion is smaller than that of the unused ink containing portion for a plurality of colors Y,M,C,K. Therefore, the related ink cartridge has a problem that waste ink can not be supplied to the waste liquid containing portion in a case that all unused ink in the liquid containing portion is sucked out by a cleaning operation because the waste liquid containing portion is filled with the waste liquid.

SUMMARY OF THE INVENTION

In consideration of the problems, it is an object of the invention to provide a liquid cartridge, a printer and a method for controlling a printer in which the program of the printer or a host device does not need to be changed corresponding to the specifications of the liquid cartridge to be used as an ink cartridge or a waste liquid storage cartridge even if the specifications of the liquid cartridge are changed.

Also, another object of the invention is to provide a near-full detection mechanism for detecting a near-full state of a waste liquid containing portion in a liquid cartridge, thereby a life time, for example, replacement timing, of the liquid cartridge can be determined by judging whether a near-full state of the waste liquid in the waste liquid containing portion is detected or an end state of the ink in an ink containing portion is detected.

In order to achieve the above object, according to the present invention, there is provided a liquid cartridge, comprising:

an ink cartridge, which has a first housing portion for containing a liquid therein for supplying the liquid to an apparatus;

a waste liquid storage cartridge, which has a second housing portion for containing a waste liquid to be supplied from the apparatus; and a rewritable nonvolatile storage portion, which stores a first threshold and a second threshold, wherein the first threshold indicates a near liquid end state in which the liquid in the first housing portion is near to end; and wherein the second threshold indicates a near full state in which the waste liquid in the second housing portion is near to full.

According to the liquid cartridge, the thresholds regarding the liquid volume and the waste liquid volume of the first and second housing portions of the ink cartridge and the waste liquid cartridge are stored in the storage portion provided in the liquid cartridge. The first threshold represents a volume obtained when the liquid is supplied to the apparatus and runs short. The second threshold represents a volume obtained when the waste liquid is supplied from the apparatus and fill near to full. By referring to the first and second thresholds, it is possible to easily grasp whether the amount of the residual liquid in the ink cartridge is eliminated and the housing portion is almost empty and whether the amount of the waste liquid in the liquid cartridge is near to full state. In other words, it is possible to clearly decide the time of the exchange of the liquid cartridge.

Preferably, the storage portion stores amount information about a liquid amount of the liquid contained in the first housing portion and a waste liquid amount of the waste liquid contained in the second housing portion. The storage portion is electrically conducted to the apparatus when the liquid cartridge is attached to the apparatus. The amount information and the first and second thresholds stored in the storage portion are transmitted to the apparatus. The amount information stored in the storage portion is updated by the apparatus every time when at least one of the liquid amount of the liquid contained in the first housing portion and the waste liquid amount of the waste liquid contained in the second housing portion is changed.

According to this structure, the latest liquid amount in the first portion is always updated and stored in the storage portion of the liquid cartridge in relation to the liquid amount of the liquid in the first housing portion in addition to the first threshold. By comparing the latest liquid amount with the first threshold, it is possible to decide the time of the exchange of the liquid cartridge. The liquid amount and the threshold for carrying out the decision are stored in the storage portion of the liquid cartridge together and the time of the exchange can be decided by only the information of the storage portion.

Preferably, the first housing portion includes a plurality of tanks for containing plural kinds of liquids respectively. The storage portion stores the amount information about the amount of each of the plural kinds of liquids.

According to this structure, the first housing portion of the ink cartridge individually accommodates the liquids having various functions therein and supplies a proper one of the liquids to meet the demand of the apparatus. The storage portion stores the amount of containment of each liquid and can always confirm each of the amounts of use.

Preferably, the ink cartridge and the waste liquid cartridge are integrally formed.

According to the present invention, there is also provided a printer, comprising:

a head, which ejects a liquid;

a liquid cartridge, which includes:

an ink cartridge, which has a first housing portion for containing the liquid therein to be ejected from the head to a printing medium for printing;

a waste liquid storage cartridge, which has a second housing portion for containing a waste liquid which is not used for the printing; and a rewritable nonvolatile storage portion, which stores a first threshold and a second threshold; and a writing/reading portion, which reads the first and second thresholds from the storage portion, wherein the first threshold indicates a near liquid end state in which the liquid in the first housing portion is near to end; and wherein the second threshold indicates a near full state in which the waste liquid in the second housing portion is near to full.

According to the printer, by referring to the first and second thresholds, it is possible to easily grasp whether the liquid amount of the liquid in the ink cartridge is eliminated and the first housing portion is almost empty or whether the waste liquid amount of the waste liquid in the waste liquid cartridge is a near full state. In other words, it is possible to clearly decide the time of the exchange of the liquid cartridge.

Preferably, the storage portion stores liquid amount information about a liquid amount of the liquid contained in the first housing portion and waste liquid amount information about a waste liquid amount of the waste liquid contained in the second housing portion. The writing/reading portion reads the liquid amount information and the waste liquid amount information from the storage portion. The printer further comprises a determinant, which judges either whether the liquid amount of the liquid amount information read from the storage portion reaches the first threshold or whether the waste liquid amount of the waste liquid amount information read from the storage portion reaches the second threshold.

Preferably, the storage portion stores liquid amount information about a liquid amount of the liquid contained in the first housing portion and waste liquid amount information about a waste liquid amount of the waste liquid contained in the second housing portion. The writing/reading portion reads the liquid amount information and the waste liquid information from the storage portion. The printer further comprises a consumed liquid calculating portion, which updates the liquid amount information based on a consumed liquid amount of the liquid in the first housing portion and the liquid amount information which is read by the writing/reading portion, a waste liquid amount calculating portion, which updates the waste liquid amount information based on a waste liquid amount of the waste liquid corresponding to a part of the consumed liquid amount and the waste liquid amount information which is read by the writing/reading portion. The writing/reading portion writes the updated liquid amount information and the updated waste liquid amount information to the storage portion.

According to this structure, the printer includes the writing/reading portion having such a function, and the ink consumption amount calculating portion. By these functions, the storage portion of the liquid cartridge always stores the latest liquid amount of the liquid and the latest waste liquid amount of the waste liquid.

Preferably, the consumed liquid calculating portion calculates the consumed liquid amount of the liquid in the first housing portion based on:

a calculation for calculating a first liquid ejection amount of the liquid ejected from the head for the printing;

a calculation for calculating a first liquid suction amount of the liquid sucked from the head in an attachment of the ink cartridge and a second liquid suction amount of the liquid sucked in cleaning of the head;

a calculation for calculating a second liquid ejection amount of the liquid ejected in flashing in which the liquid is ejected to a predetermined portion other than the printing medium for preventing the head from being clogged in the printing; and a calculation for calculating the latest liquid amount contained in the first housing portion based on the first and second liquid ejection amounts and the first and second suction amounts in accordance with results of the calculations.

According to this structure, the liquid consumption amount calculating portion of the printer calculates the amount of the ink used for the printing and the amounts of the ink used for cleaning and flashing to maintain the function of the head respectively and newly calculates the amount of containment of the ink in the ink cartridge based on the result of the calculation. By the ink consumption amount calculating portion, the amount of consumption of the ink for each purpose can be calculated and the amount of containment of the ink in the ink cartridge can also be grasped.

Preferably, the waste liquid amount calculating portion calculates the waste liquid amount based on:

a calculation for calculating a first liquid suction amount of the liquid sucked from the head in an attachment of the ink cartridge;

a calculation for calculating a second liquid suction amount of the liquid sucked in cleaning of the head;

a calculation for calculating a liquid ejection amount of the liquid ejected in flashing in which the liquid is ejected to a predetermined portion other than the printing medium for preventing the head from being clogged in the printing; and a calculation for calculating the latest waste liquid amount contained in the second housing portion based on the liquid ejection amount and the first and second suction amounts in accordance with results of the calculations.

According to this structure, the waste liquid consumption amount calculating portion of the printer calculates the waste liquid amount of the liquid used for cleaning and flashing to maintain the function of the head respectively and newly calculates the waste liquid amount of the waste liquid in the waste liquid cartridge based on the result of the calculation. By the waste liquid amount calculating portion, the waste liquid amount for each purpose can be calculated and the waste liquid amount of the waste liquid in the waste liquid cartridge can also be grasped.

Preferably, the printer further comprises an attaching portion. When the liquid cartridge is attached to the attaching portion, the storage portion is electrically conducted to the writing/reading portion. The writing/reading portion reads the liquid amount information, the waste liquid amount information and the first and second thresholds from the storage portion. The writing/reading portion updates the liquid amount information every time when the liquid amount of the liquid in the first housing portion is changed. The writing/reading portion updates the waste liquid amount information every time when the waste liquid amount of the waste liquid in the second housing portion is changed.

According to this structure, the latest liquid amount information is always stored in the storage portion.

Preferably, the first housing portion includes a plurality of tanks for containing plural kinds of liquids respectively. The storage portion stores the liquid amount information about the amount of each of the plural kinds of liquids.

According to this structure, the first housing portion individually accommodates inks having a plurality of colors for color printing, for example, and the printing expression of the printer can be diversified. The storage portion stores the liquid amount of each ink and each amount of use can be always confirmed.

Preferably, the ink cartridge and the waste liquid cartridge are integrally formed.

According to this structure, the waste liquid and the liquid are accommodated in the integrated liquid cartridge. Therefore, the structure of attachment can be simplified and the storage portion can also be provided in one place. Thus, the cartridge is easy to handle.

According to the present invention, there is also provided a method for controlling a printer, comprising:

reading a first threshold regarding a liquid and a second threshold regarding a waste liquid from a rewritable nonvolatile storage portion of a liquid cartridge, the liquid cartridge including an ink cartridge which has a first housing portion for containing the liquid to be ejected from a head and a waste liquid storage cartridge which has a second housing portion for containing the waste liquid which is not used for the printing; and transmitting a predetermined instruction either when a liquid amount of the liquid contained in the first housing portion reaches the first threshold or when a waste liquid amount of the waste liquid contained in the second housing portion reaches the second threshold.

According to the method of controlling a printer, the printer displays the purport that the ink cartridge is almost empty of the liquid on a display or through a lamp display, for example for notifying to a user or displays the purport that the waste liquid storage cartridge is almost full with the waste liquid on a display or through a lamp display, for example for notifying to a user. The user can know that the liquid in the ink cartridge is almost empty of the liquid or the waste liquid storage cartridge is almost full of the waste liquid through the notice.

Preferably, the method further comprising:

reading a liquid amount information about the liquid amount of the liquid in the first portion from the storage portion;

calculating a consumed liquid amount of the liquid in the first housing portion:

updating the liquid amount information based on the consumed liquid amount and the read liquid amount information; and writing the updated liquid amount information to the storage portion.

The method further comprises: judging whether the liquid amount of the updated liquid amount information reaches the first threshold; and informing a near liquid end state based on a result of the judging function. The first threshold indicates the near liquid end state in which the liquid in the first housing portion is near to end.

The method further comprises:

judging whether the liquid amount of the updated liquid amount information reaches the first threshold; and informing a near liquid end state based on a result of the judging function, wherein the first threshold indicates the near liquid end state in which the liquid in the first housing portion is near to end.

According to the method, the printer calculates the liquid amount based on the consumed liquid amount which is consumed by the printer. It is decided whether or not the liquid amount calculated reaches the first threshold and near-end in a state in which the liquid amount runs short is brought. The liquid amount which is calculated is overwritten to the storage portion of the ink cartridge and the latest liquid amount is always stored.

Preferably, the calculating function of the consumed liquid amount of the liquid in the first housing portion includes:

calculating a first liquid ejection amount of the liquid ejected from the head for the printing;

calculating a first liquid suction amount of the liquid sucked from the head in an attachment of the ink cartridge and a second liquid suction amount of the liquid sucked in cleaning of the head;

calculating a second liquid ejection amount of the liquid ejected in flashing in which the liquid is ejected to a predetermined portion other than the printing medium for preventing the head from being clogged in the printing; and calculating the latest liquid amount contained in the first housing portion based on the first and second liquid ejection amounts and the first and second suction amounts in accordance with results of the calculating functions.

In the above method, the function of calculating the amount of consumption of the ink includes the steps of calculating the amount of the ink used for the printing and the amounts of the ink used for the cleaning and the flashing to maintain the function of the head respectively and newly calculating the amount of containment of the ink in the ink cartridge based on the result of the calculation. By each of the steps, the amount of consummation of the ink for each purpose can be calculated and the amount of containment of the ink in the ink cartridge can also be grasped.

Preferably, the method further comprising:

reading a waste liquid amount information about the waste liquid amount of the waste liquid in the second portion from the storage portion;

calculating a consumed waste liquid amount of the waste liquid corresponding to a part of the consumed liquid amount;

updating the waste liquid amount information based on the consumed waste liquid amount and the read waste liquid amount information; and writing the updated waste liquid amount information to the storage portion.

Preferably, the method further comprising:

judging whether the waste liquid amount of the updated waste liquid amount information reaches the second threshold; and informing a near liquid full state based on a result of the judging function, wherein the second threshold indicates the near liquid full state in which the waste liquid in the second housing portion is near to full.

In the above method, the printer calculates the amount of containment of the waste liquid in the waste liquid storage cartridge based on the amount of the ink corresponding to the waste liquid on the basis of the amount of consumption of the ink consumed by the printer. It is decided whether or not the amount of containment thus calculated reaches the threshold and the waste liquid storage cartridge is almost full of the amount of the waste liquid, that is, near-full is brought. The amount of containment which is calculated is overwritten to the storage portion of the waste liquid storage cartridge and the newest amount of containment is always stored.

Preferably, the calculating function of the consumed waste liquid amount of the waste liquid in the second housing portion includes:

calculating a first liquid suction amount of the liquid sucked from the head in an attachment of the ink cartridge;

calculating a second liquid suction amount of the liquid sucked in cleaning of the head;

calculating a liquid ejection amount of the liquid ejected in flashing in which the liquid is ejected to a predetermined portion other than the printing medium for preventing the head from being clogged in the printing; and calculating the latest waste liquid amount contained in the second housing portion based on the liquid ejection amount and the first and second suction amounts in accordance with results of the calculating functions.

According to the method, the step of calculating the amount of consumption of the ink includes the steps of calculating the amount of the ink used for the printing and the amount of the ink used for the cleaning and the flashing to maintain the function of the head respectively and newly calculating the amount of containment of the waste liquid in the waste liquid storage cartridge based on the result of the calculation. By each of the steps, the amount of consumption of the ink for each purpose including the amount of the waste liquid can be calculated and the ink can be managed minutely.

BRIEF DESCRIPTION OF THE DRAWINGS

The above objects and advantages of the present invention will become more apparent by describing in detail preferred exemplary embodiments thereof with reference to the accompanying drawings, wherein:

FIG. 11 is a flowchart showing the flow of an execution processing when a power supply is turned ON.

DETAILED DESCRIPTION OF THE PREFERRED EMBODIMENTS

Figure 1:
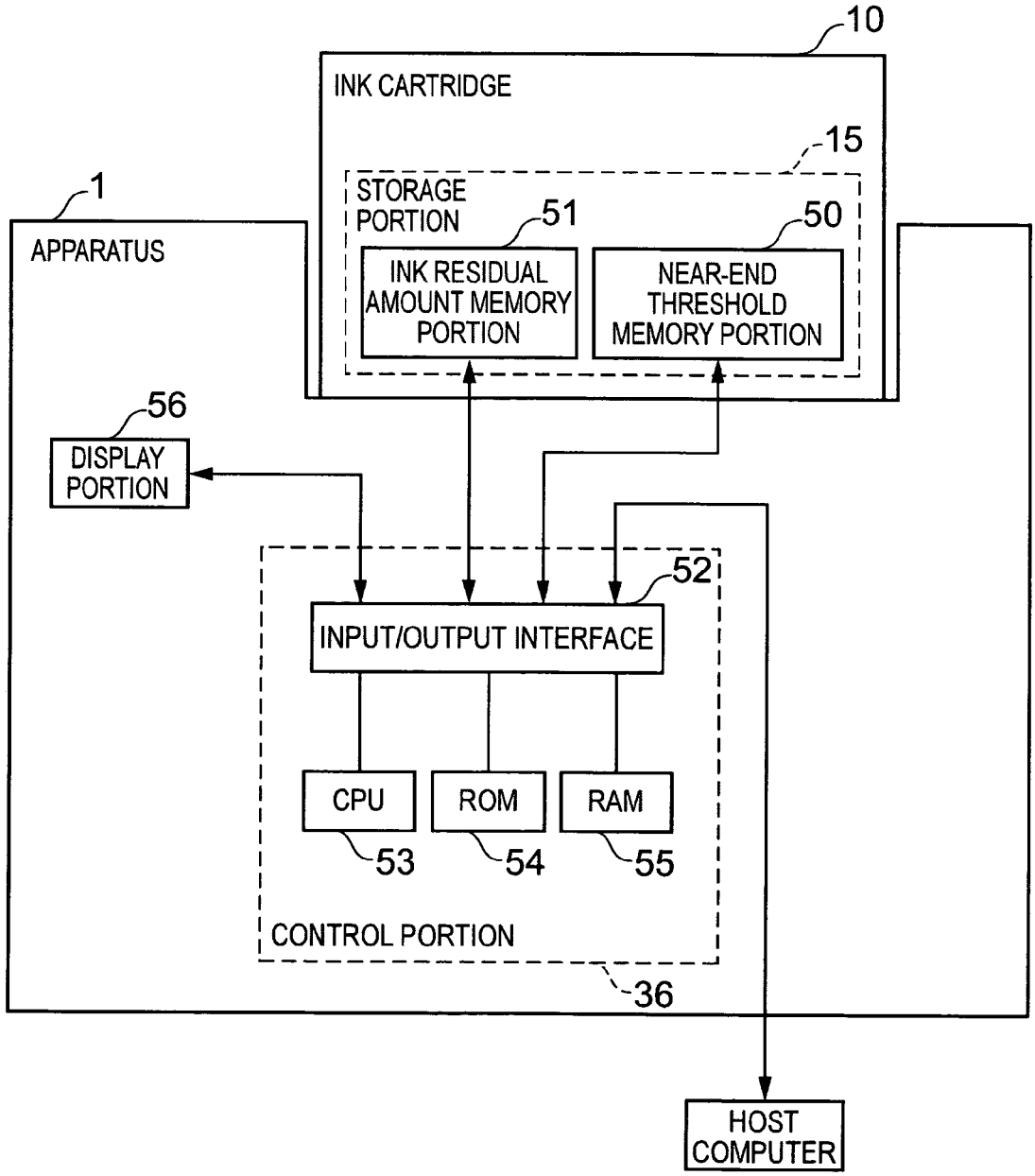
FIG. 1 is a typical diagram showing the relationship of a data transfer between an ink cartridge and an apparatus according to the invention.

An ink cartridge serving as a liquid cartridge according to the invention will be described below with reference to the accompanying drawings. As shown in FIG. 1, an ink cartridge 10 is attached to an apparatus 1, and supplies a liquid contained in the ink cartridge 10 to the apparatus 1. Moreover, the ink cartridge 10 includes a rewritable nonvolatile storage portion 15. The storage portion 15 has a liquid residual amount memory portion 51 for storing, as a value, residual amount information about the amount of containment of the liquid contained in the ink cartridge 10, and a near-end threshold memory portion 50 for storing the threshold of the volume of the liquid. The threshold represents that the residual amount of the liquid is almost zero. The apparatus 1 includes a control portion 36, a display portion 56 for displaying a control state, and a mechanism portion (not shown) for ejecting a liquid. The control portion 36 has an input/output interface 52 for carrying out an input/output together with the storage portion 15 of the ink cartridge 10 and a host such as a personal computer, and a CPU 53, an ROM 54 and an RAM 55 which perform various processings.

When the ink cartridge 10 is attached to the apparatus 1, the storage portion 15 of the ink cartridge 10 and the control portion 36 of the apparatus 1 are electrically conducted. The value of the residual amount of the liquid contained in the ink cartridge 10 is fetched from the liquid residual amount memory portion 51 into the control portion 36 and a near-end threshold is fetched from the near-end threshold memory portion 50 into the control portion 36. The control portion 36 compares the residual amount value with the near-end threshold and decides whether or not the liquid in the ink cartridge 10 is almost empty. The residual amount value stored in the liquid residual amount memory portion 51 is updated by the control portion 36 every time the liquid is ejected from the mechanism portion of the apparatus 1 so that the amount of the liquid remaining in the ink cartridge 10 is changed. The residual amount value thus updated is written to the storage portion 15. Even if the ink cartridge 10 accommodates plural kinds of liquids therein, the same management and processing is carried out for each of the liquids.

The ink cartridge 10 has the near-end threshold indicating that the liquid contained in the ink cartridge 10 is almost empty and the residual amount value of the liquid in the ink cartridge 10. Consequently, it is sufficient that the control portion 36 has a capability of a general purpose processing such as a data fetch from the storage portion 15, a data comparison and the update of the residual amount value. Accordingly, the control portion 36 of the apparatus 1 has such a structure that it is not necessary to carry out version-up by the new addition of the ink cartridge 10 or the change in the specifications and the burden of the user is lessened in respect of the maintenance of the apparatus.

Figure 2:
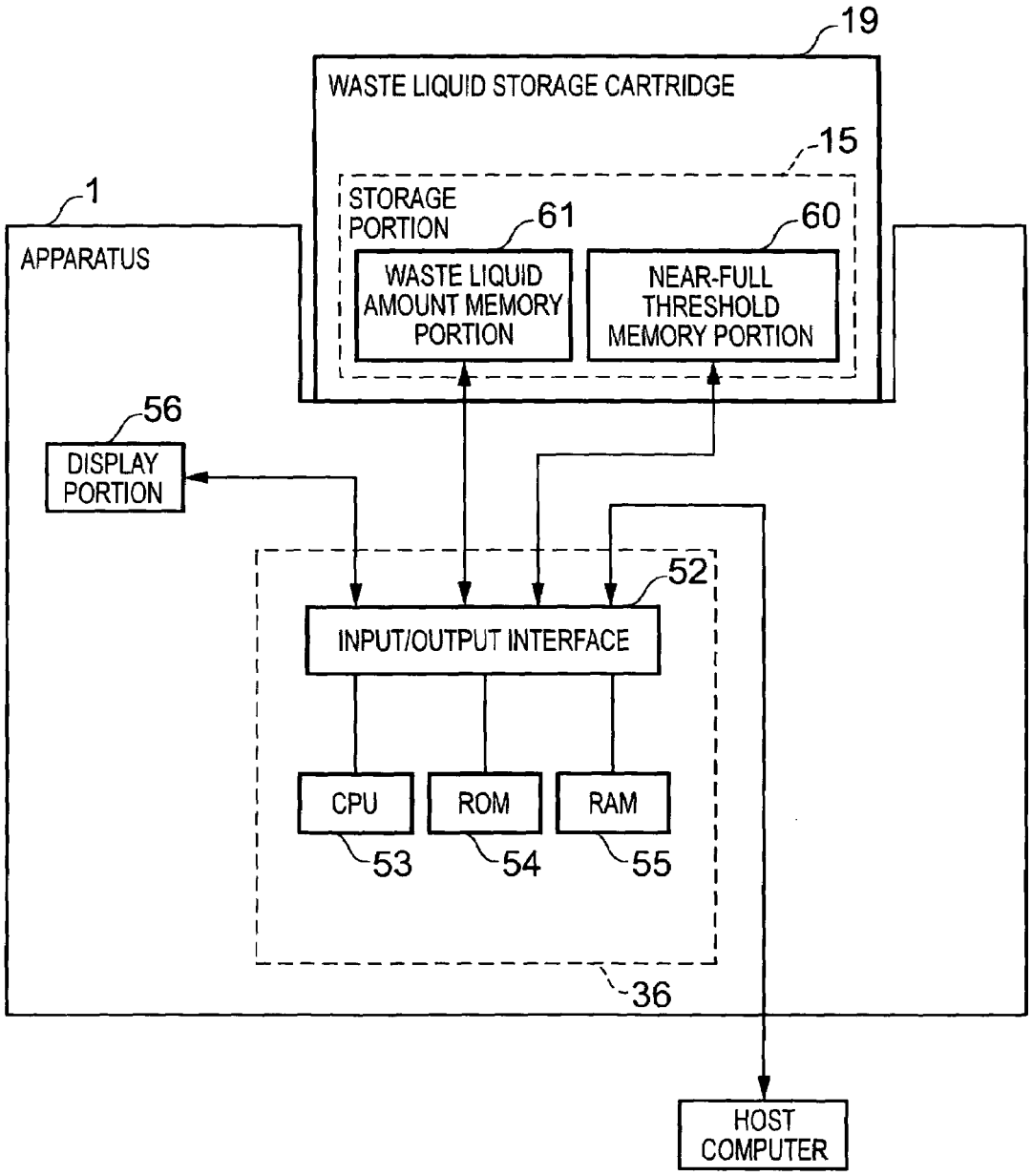
FIG. 2 is a typical diagram showing the relationship of a data transfer between a waste liquid storage cartridge and the apparatus according to the invention.

Next, description will be given to a waste liquid storage cartridge included in the liquid cartridge according to the invention. As shown in FIG. 2, a waste liquid storage cartridge 19 is attached to the apparatus 1 and accommodates a waste liquid supplied from the apparatus 1. Moreover, the waste liquid storage cartridge 19 includes the rewritable nonvolatile storage portion 15. The storage portion 15 has a waste liquid amount memory portion 61 for storing, as a value, information about the amount of containment of a waste liquid contained in the housing portion of the waste liquid storage cartridge 19, and a near-full threshold memory portion 60 for storing the threshold of the volume of the housing portion. The threshold represents that the waste liquid storage cartridge 19 is almost full of the waste liquid. The apparatus 1 includes the control portion 36, the display portion 56 for displaying a control state, and the mechanism portion (not shown) for carrying out the function and action of the apparatus 1. The control portion 36 has the input/output interface 52 for carrying out an input/output together with the storage portion 15 of the waste liquid storage cartridge 19 and a host such as a personal computer, and the CPU 53, the ROM 54 and the RAM 55 which perform various processings.

When the waste liquid storage cartridge 19 is attached to the apparatus 1, the storage portion 15 of the waste liquid storage cartridge 19 and the control portion 36 of the apparatus 1 are electrically conducted. The value of the amount of containment of the waste liquid contained in the waste liquid storage cartridge 19 is fetched from the waste liquid amount memory portion 61 into the control portion 36, and a near-full threshold is fetched from the near-full threshold memory portion 60 into the control portion 36. The control portion 36 compares the value of the amount of containment with the near-full threshold and decides whether or not the waste liquid storage cartridge 19 is almost full of the waste liquid. The value of the amount of containment which is stored in the waste liquid amount memory portion 61 is updated by the control portion 36 every time the waste liquid is collected from the mechanism portion of the apparatus 1 so that the amount of containment of the waste liquid in the waste liquid storage cartridge 19 is changed. The value of the amount of containment thus updated is written to the storage portion 15.

The waste liquid storage cartridge 19 has the near-full threshold indicating that the waste liquid storage cartridge 19 is almost full of the waste liquid and the value of the amount of containment of the waste liquid. Consequently, it is sufficient that the control portion 36 has a capability of a general purpose processing such as a data fetch from the storage portion 15, a data comparison and the update of the value of storage. Accordingly, the control portion 36 of the apparatus 1 has such a structure that it is not necessary to carry out version-up by the new addition of the waste liquid storage cartridge 19 or the change in the specifications and the burden of the user is eliminated in respect of the maintenance of the apparatus.

Next, the invention will be described in detail by taking, as an example, the case in which the waste liquid storage cartridge 19 is fixed to a printer of an ink jet type in which the apparatus 1 has the ink cartridge 10 attached thereto and ejects an ink in a droplet condition from a head to carry out printing on a paper to be printed.

EXAMPLE 1

Figure 3:
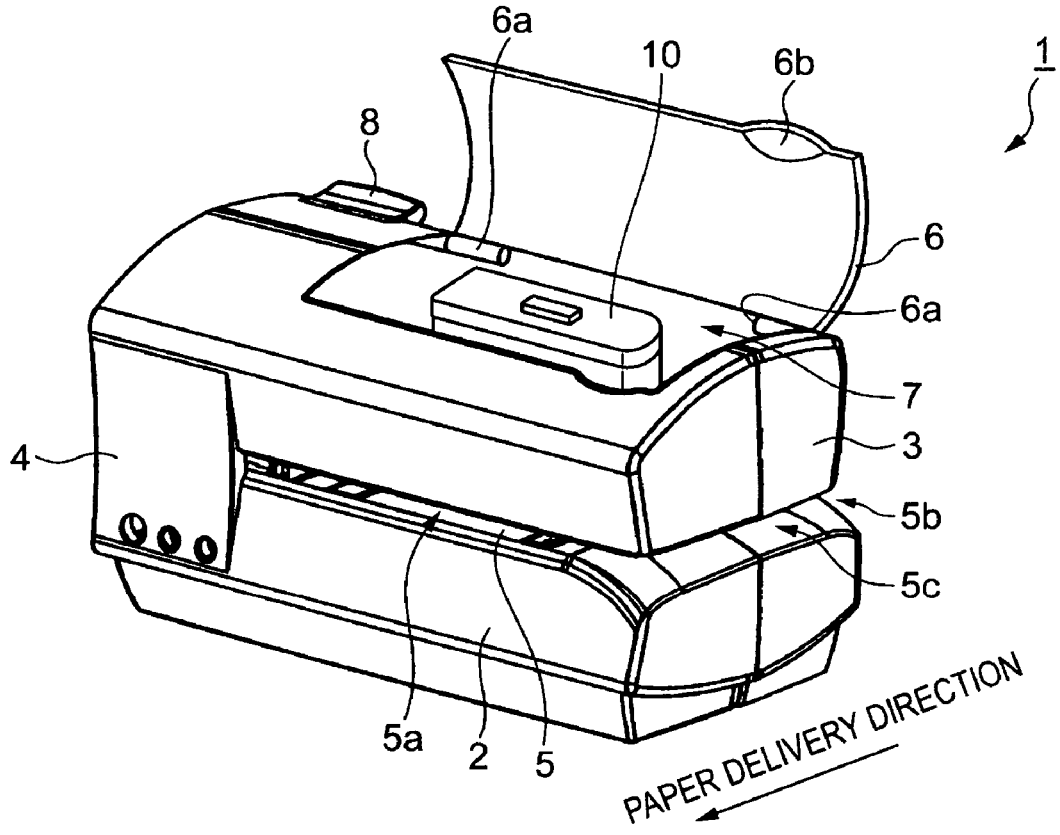
FIG. 3 is a perspective view showing the appearance of a printer.

FIG. 3 is a perspective view showing the appearance of the printer 1 according to the invention. The printer 1 includes a base portion 2, a cantilever portion 4 positioned on one of the ends of the base portion 2, and a recording portion 3 overhung through the cantilever portion 4. A paper transport path 5 for inserting a paper is provided between the base portion 2 and the recording portion 3. In the paper transport path 5, three directions other than the cantilever portion 4 communicate as a front opening 5*a*, a back opening 5*b* and a side opening 5*c*. Moreover, an opening portion 7 for removing and attaching the ink cartridge 10, a cover 6 for closing the opening portion 7, a hinge 6*a* for fixing the cover 6 to the recording portion 3, and an opening/closing projection 6*b* provided on one of the corners of the cover 6 and serving to easily carry out the opening/closing operation are provided on the opposite side to the base portion 2 side of the recording portion 3. A release lever 8 for pressing or releasing the paper in the paper transport path 5 is provided on the back opening 5*b* side of the cantilever portion 4. In the case that the release lever 8 releases the paper, a user can manually remove or insert the paper. The ink cartridge 10 is accommodated in the recording portion 3 so as to be removable or attachable through the opening portion 7.

Figure 4:
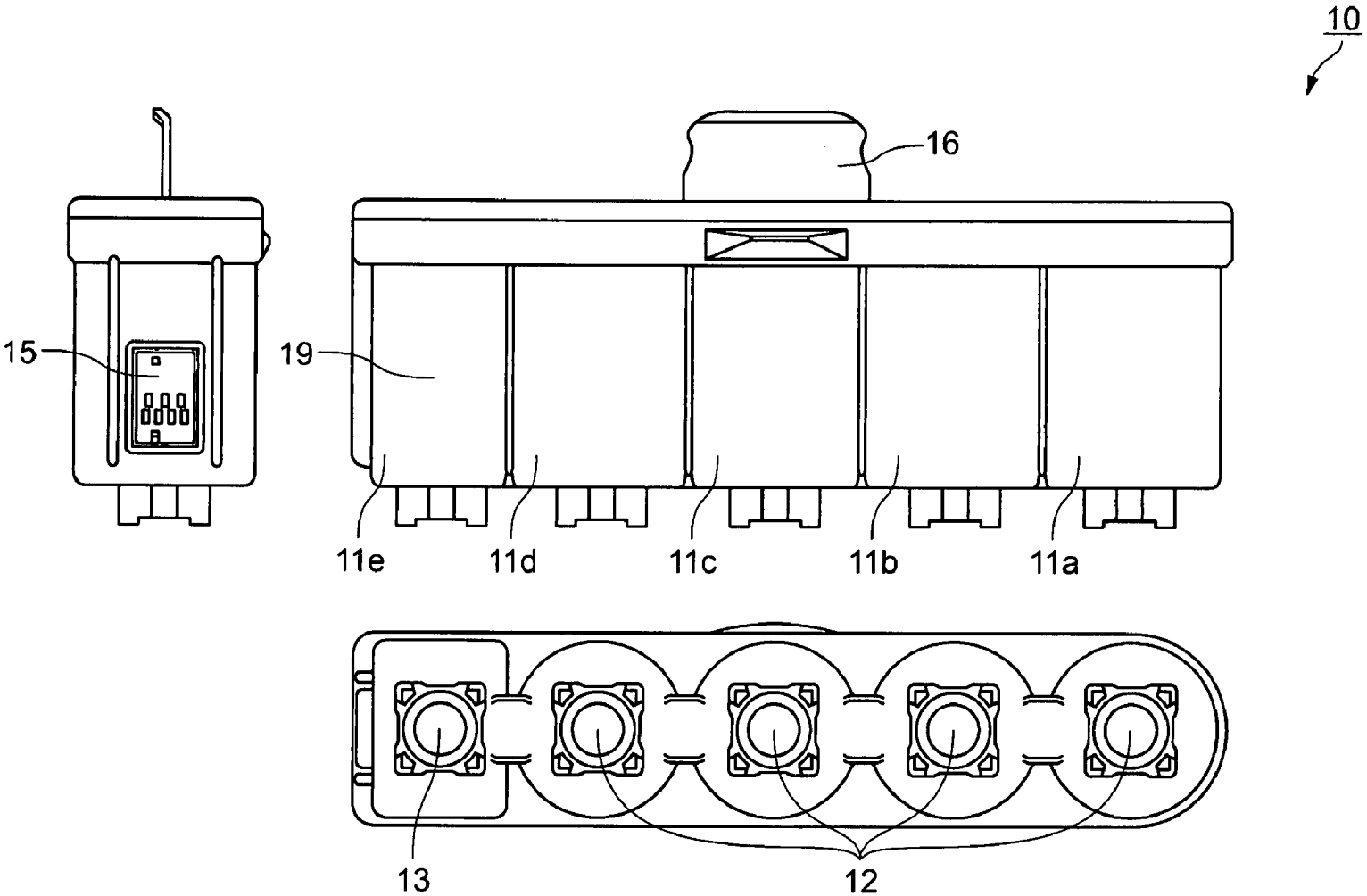
FIG. 4 is a view showing the appearance of the ink cartridge.

FIG. 4 is a view showing the appearance of the ink cartridge 10. The ink cartridge 10 includes a housing portion 11 having the shape of an almost rectangular parallelepiped in which a cyan color tank 11*a* for accommodating a cyan color ink for printing, a magenta color tank 11*b* for accommodating a magenta color ink for printing, a yellow color tank 11*c* for accommodating a yellow color ink for printing, a black color tank 11*d* for accommodating a black color ink for printing, and a waste liquid tank 11*e* serving as the waste liquid storage cartridge 19 are sequentially coupled and integrated. A tab 16 for taking the ink cartridge 10 out of the printer 1 is provided on one of the surfaces of the housing portion 11. Moreover, the ink tanks include ink supply ports 12 for supplying the ink to the printer 1 are respectively provided on a surface at an opposite side to the surface on which the tab 16 is provided. The waste liquid tank 11*e* is provided with a waste liquid inlet 13 for receiving a waste liquid.

Furthermore, the storage portion 15 for storing information about the ink cartridge 10 is provided on one of the side surfaces of the waste liquid tank 11*e*. The storage portion 15 is an EEPROM such as a flash memory to be a rewritable nonvolatile memory.

Figure 5:
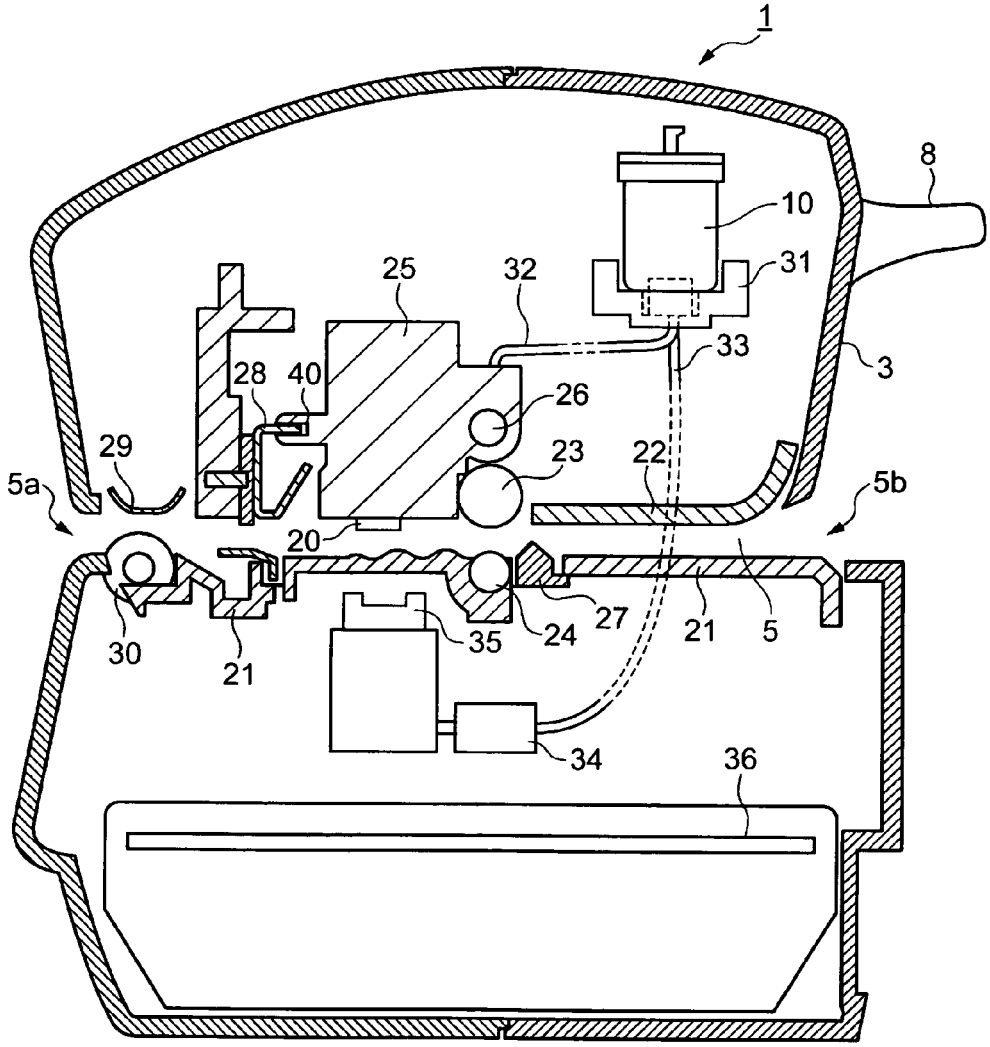
FIG. 5 is a sectional view showing the structure of the ink supply system of the printer.
Figure 6:
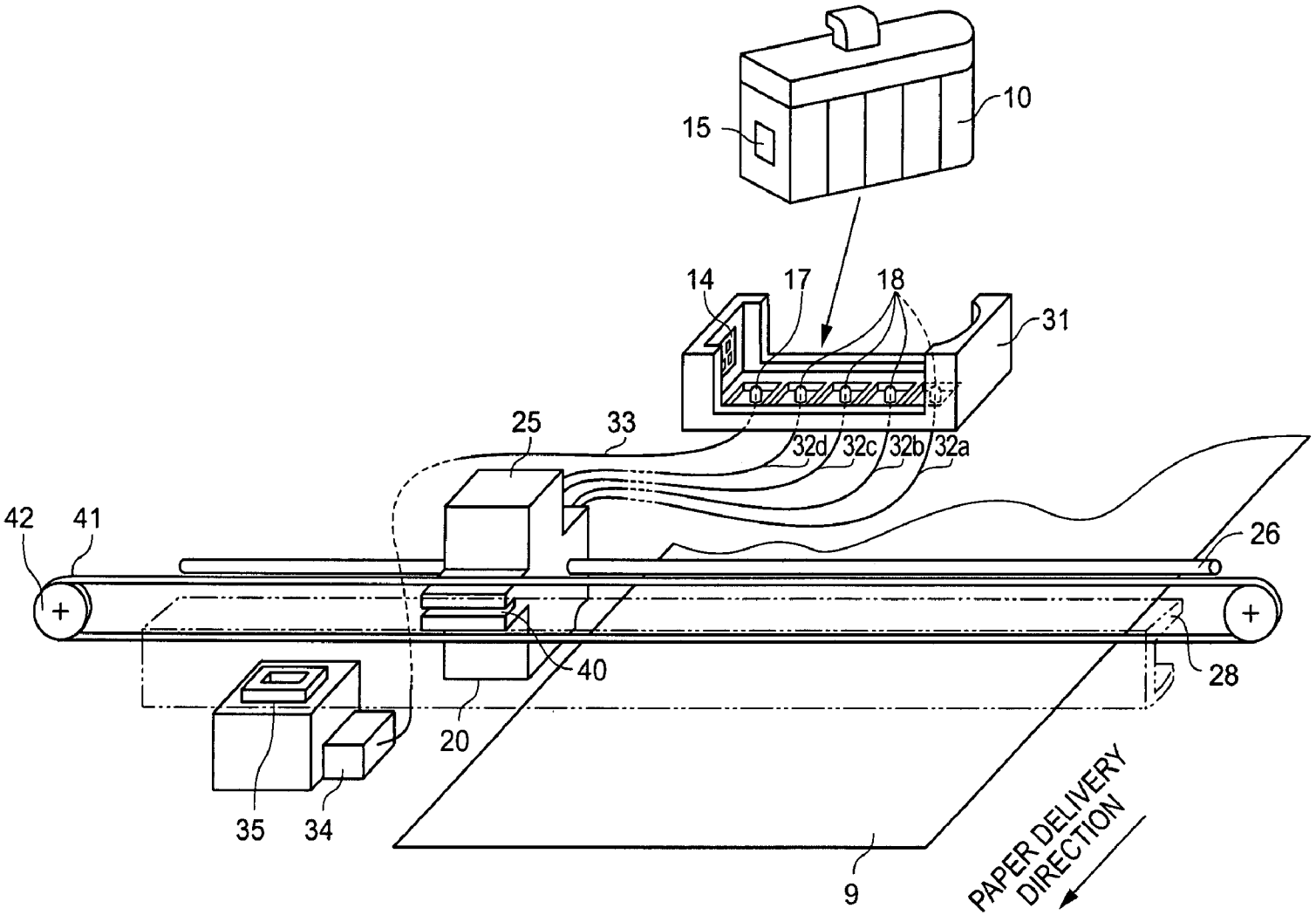
FIG. 6 is a typical view showing the schematic structure of the printer.

FIG. 5 is a sectional view showing the structure of the ink supply system of the printer 1, and FIG. 6 is a typical view showing the schematic structure of the printer 1. A portion with respect to the ink of the printer 1 will be first described with reference to both of the drawings. The recording portion 3 of the printer 1 includes a cartridge holder 31 for attaching the ink cartridge 10 thereto, an ink supply tube 32 for supplying an ink from the ink cartridge 10 through the cartridge holder 31 to a head 20, a carriage 25 for holding the head 20, a guide shaft 26 for guiding the movement of the carriage 25, and a guide plate 28 to be engaged with a slide groove 40 provided on the carriage 25.

The guide shaft 26 and the guide plate 28 are extended in the direction of the cantilever portion 4 from the side opening 5*c* side of the recording portion 3. For this reason, the carriage 25 can be moved along the guide shaft 26 and the guide plate 28. The movement of the carriage 25 is carried out by a ring-shaped timing belt 41 which is provided in parallel with the guide plate 28 and has both ends stretched through rotatable pulleys. A pulley 42 on the cantilever portion 4 side is interlocked with a motor and the timing belt 41 is rotated by the rotation of the pulley 42 so that the carriage 25 coupled to the timing belt 41 can be moved.

The cartridge holder 31 is further provided with a waste liquid tube 33 for receiving a waste liquid to the ink cartridge 10 which communicates with a pump 34 and a capping portion 35 provided in the lower part of the cantilever portion 4. The capping portion 35 is a maintenance device for maintaining the function of the head 20. When the head 20 is moved to a part provided just above the capping portion 35, the capping portion 35 is lifted by a cam mechanism and seals the head 20. Then, the ink is forcibly sucked from the head 20 by the sucking action of the pump 34. By the sucking action, it is possible to prevent the head 20 from being clogged due to the dryness of the ink and foreign substances from sticking. The maintenance will be referred to as cleaning. In the middle of the printing, moreover, the ink is simultaneously ejected from the head 20 in the position of the capping portion 35 in order to prevent the head portion having a small ink ejection from causing an abnormality such as the clogging. The maintenance will be referred to as flashing. The cleaning and the flashing are carried out periodically when the printing in a predetermined amount is carried out, and it is possible to always hold a state in which the ink can be ejected normally.

Description will be given to the cartridge holder 31 to attach the ink cartridge 10 thereto. The cartridge holder 31 includes four ink inlet portions 18 for receiving the ink from the corresponding ink supply port 12 of the ink cartridge 10, a waste liquid supply portion 17 for supplying a waste liquid to the waste liquid inlet 13, and a holder board portion 14 for being conducted to the storage portion 15 to transfer data in an inside portion for attaching the ink cartridge 10 thereto.

When the ink cartridge 10 is attached to the cartridge holder 31, the ink supply port 12 and the ink inlet portion 18 are connected to each other so that each of the inks having the colors is supplied to the head 20 through ink supply tubes 32*a*, 32*b*, 32*c* and 32*d*. At this time, a surface on which the storage portion 15 is provided takes a square shape and a surface on an opposite side takes a circular shape as shown in FIG. 4 in such a manner that the storage portion 15 of the ink cartridge 10 is not attached to the holder board portion 14 in an opposite direction. Accordingly, the ink cartridge 10 can be reliably pushed into the cartridge holder 31 in only a correct direction.

In this case, there is employed a so-called off-carriage structure in which the ink cartridge 10 and the carriage 25 are positioned apart from each other. It is also possible to employ a so-called on-carriage structure in which the ink cartridge 10 is mounted on the carriage 25 and they are moved integrally.

Next, description will be given to a mechanism for transporting a paper 9. The lower surface of the paper transport path 5 reaching the front opening 5*a* from the back opening 5*b* of the printer 1 is mainly constituted by a platen 21 to be a plate-shaped member, and furthermore, a BOF lever 27 for sensing the paper 9, a paper feed roller 24 and a paper delivery subroller 30 are provided in the direction of the back opening 5*b* to be the upstream side of the delivery of the paper 9. The upper surface of the paper transport path 5 which is opposed to the platen 21 is provided with a paper guide 22, a paper delivery main roller 23 opposed to the paper feed roller 24, a carriage 25, and a TOF lever 29 opposed to the paper delivery subroller 30 in the direction of the back opening 5*b*. The TOF lever 29 serves to sense the paper 9 in the same manner as the BOF lever 27. The control portion 36 is provided below the platen 21.

In the printer 1, the paper 9 can be inserted in a state in which the vertical direction of the paper transport path 5 has a Space as shown in FIG. 5. When the paper 9 is inserted into the paper transport path 5 to push up the release lever 8, the platen 21 is lifted to hold the paper 9. At this time, the BOF lever 27 is pushed down by the paper 9 and the TOF lever 29 is pushed up, thereby sensing that the paper 9 is inserted respectively. The paper 9 is interposed between the paper delivery main roller 23 and the paper feed roller 24, and is once fed in the direction of the back opening 5*b* by the rotation of the paper delivery main roller 23 driven by the motor. When the paper 9 goes away from the TOF lever 29, the position is recognized to be the tip portion of the paper 9, which is a basis for controlling the subsequent feed of the paper 9. When the paper 9 is inserted in a state in which it is not caught on either the BOF lever 27 or the TOF lever 29, the paper 9 is first moved to a position in which it is sensed by both of the levers 27 and 29 and the tip portion is then recognized.

Thus, the three directions of the paper transport path 5 are opened. In particular, therefore, printing can be carried out in a special state, for example, the printing is performed over one of a large number of filed papers in a filing condition. It is also possible to carry out an automatic paper feed in a state in which a standard size paper feeding device or a calendered paper feeding device is fixed.

Figure 7:
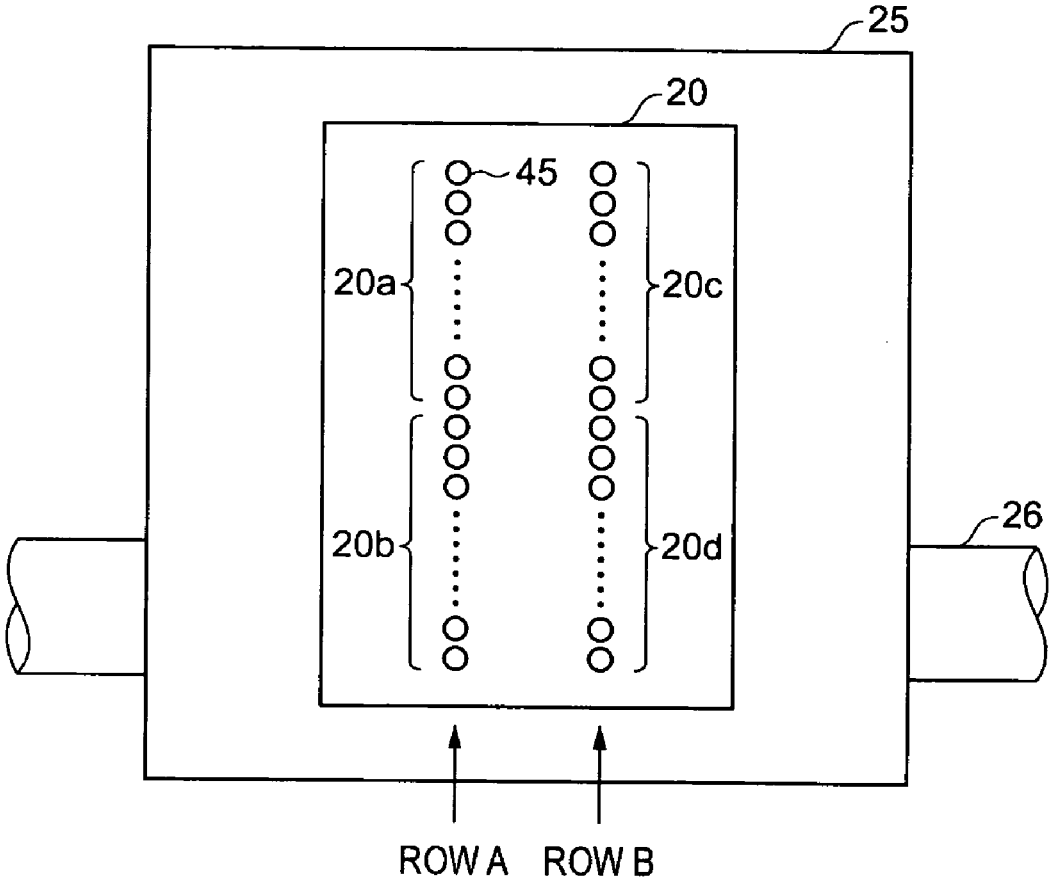
FIG. 7 is a plan view showing the structure of a head.

Next, the structure of the head 20 will be described with reference to FIG. 7. FIG. 7 is a view showing the head 20 as seen from the paper 9 side. The head 20 has 128 nozzles 45 for ejecting an ink. The 128 nozzles 45 are constituted by two nozzle rows including A and B rows, each of which has 64 nozzles. 32 nozzles 45 (20*a*) belonging to the A row eject a ink having a cyan color and residual 32 nozzles 45 (20*b*) eject an ink having a magenta color. Similarly, 20*c* and 20*d* of the nozzles 45 in the B row eject inks having yellow and black colors, respectively. In the head 20 having such a structure, the A and B rows are arranged in the same direction as the delivery direction of the paper 9, and the paper 9 is fed every width subjected to the printing through the 32 nozzles 45 in the printing. For example, if all of the inks have the black color, the paper can be fed every width subjected to the printing through the 64 nozzles 45. Thus, a printing speed can also be increased.

For a mechanism to eject the ink from the nozzle 45, a well-known electrostatic actuator type is used. It is possible to set an ejection pattern and an ejection amount which are suitable for the kind of the ink, for example, a pigment type or a dye type. Accordingly, the ink can be selected widely and multi-use printing can be carried out. In the case in which the ink cartridge 10 accommodating different inks is to be used, it is necessary to wash the ink passage of the printer 1. In that case, the ink cartridge 10 accommodating a washing agent in place of the ink is attached to the printer 1 to carry out cleaning. The washing agent is collected as a waste liquid into the same ink cartridge 10. Therefore, the printer 1 side does not specially consider a program for washing or an additional device, for example. The mechanism for discharging the ink may be of a type using a piezo element or an electrothermal converting unit in addition to the electrostatic actuator type.

While the ink cartridge 10 having a structure in which an ink housing portion and a waste liquid housing portion are integrated is easy to handle, furthermore, it is also possible to individually exchange the ink housing portion and the waste liquid housing portion which are formed separately. Moreover, the inks can also be exchanged individually by accommodating each color in a separate housing portion. Thus, each ink color and the waste liquid can be managed more minutely.

Figure 8:
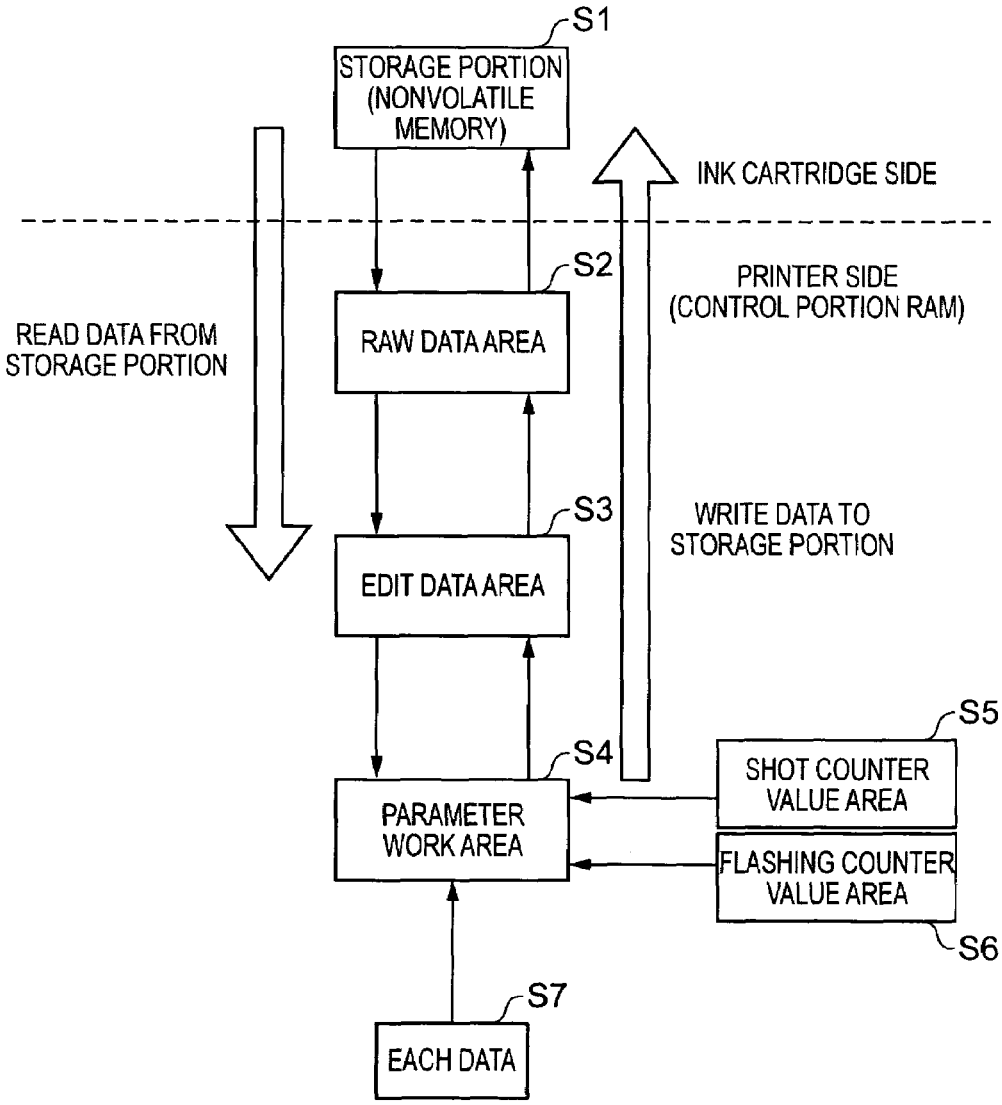
FIG. 8 is a flowchart showing the concept of a data processing in an ink cartridge storage portion and the printer.

The structure and action of the printer 1 has been described above. Next, description will be given to a method of controlling the printer 1 in relation to the ink. FIG. 8 is a flowchart showing the concept of the data processing of the storage portion 15 of the ink cartridge 10 and the control portion 36 of the printer 1. When the ink cartridge 10 is attached to the printer 1, the storage portion 15 of the ink cartridge 10 and the control portion 36 of the printer 1 are electrically conducted and data on the ink of the storage portion 15 are sent to the control portion 36 (step S1). In the control portion 36, the data of the storage portion 15 are fetched into the RAM 55 under control of the CPU 53 and various controls are carried out corresponding to the information of the ROM 54 in which the driving and control of the head 20 and the pump 34 is previously incorporated.

Figure 9:
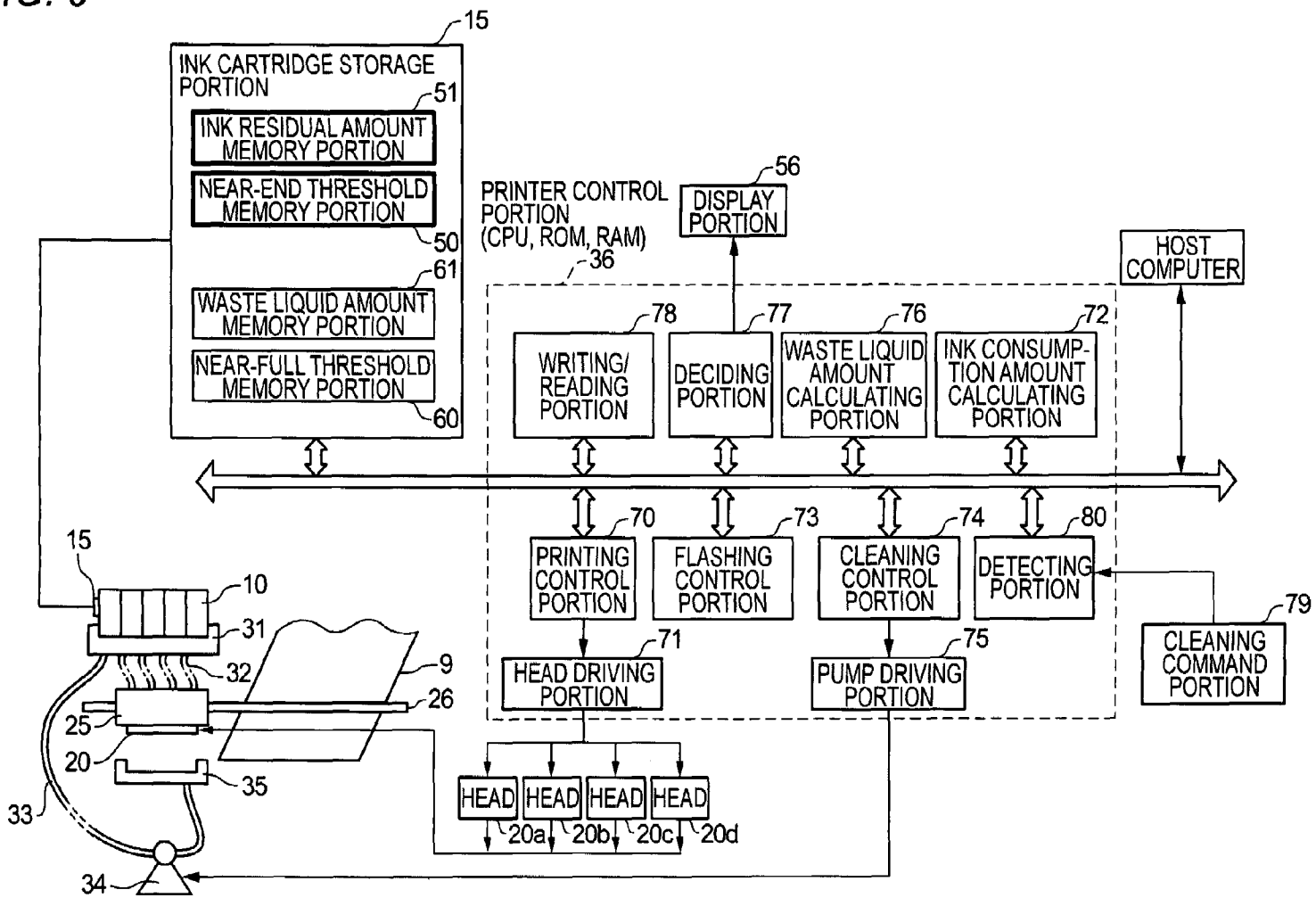
FIG. 9 is a block diagram showing a processing related to the amount of an ink in the ink cartridge storage portion and the printer.

Main data on the ink are stored in the ink residual amount memory portion 51 for storing the amount of a residual ink, the near-end threshold memory portion 50 for storing a near-end threshold to decide whether or not the ink runs short, the waste liquid amount memory portion 61 for storing the amount of a waste liquid, and the near-full threshold memory portion 60 for storing a near-full threshold to decide whether or not the waste liquid tank 11*e* is almost full of the waste liquid as shown in the ink cartridge storage portion 15 of FIG. 9. In addition, there are information about the type of an ink, for example, a pigment type or a dye type, the color of the accommodated ink, a manufacturing date and a serial number. The data to be edited and updated based on the consumption of the ink in the printer 1 include an ink residual amount value and a waste liquid amount value.

The data (information) sent from the storage portion 15 are fetched into the raw data area of the RAM 55 in the control portion 36 and are stored therein (S2). Furthermore, the ink residual amount value and the waste liquid amount value are transmitted to an edit data area for an edit (S3). Data in the edit data area are treated as a variable (parameter), and are fetched into a parameter work area and are calculated therein (S4). During the calculation in the parameter work area, the number of times of the ejection of the ink from the head 20 is counted to fetch data from a shot counter value area for calculating the amount of consumption of the ink (S5) and to fetch data from a flashing counter value area for calculating the amount of consumption of the ink by flashing and cleaning (S6). Moreover, data on the ejection pattern of the head 20 and the amount of ejection of the data per time based on the type of the ink are also fetched (S7).

The shot counter value area counts the number of times of the ejection of the ink from the head 20 in relation to printing, thereby carrying out a processing of calculating the amount of consumption of the ink. Moreover, the flashing counter value area counts the number of times of the ejection of the ink by the flashing from the head 20 in a capping position, and furthermore, replaces the amount of suction of the ink by the cleaning in the same capping position with the number of times of the ejection of the ink from the head 20, thereby carrying out the processing of calculating the amount of consumption of the ink. In other words, the total amount of consumption of the ink is obtained by summing up the amounts of consumption of the ink calculated in the shot counter value area. The amount of consumption of the ink calculated in the flashing counter value area corresponds to the amount of the ink to be collected as a waste liquid. The amount of the ink is represented by setting the number of times of the ejection to be a substitution value.

In the processing of calculating the amount of consumption of the ink in the shot counter value area, every time the number of times of the ejection of the ink from the head 20 reaches a constant number of times, a predetermined value, for example, 1 Digit is subtracted from the ink residual amount value fetched in the parameter work area. In this case, a value converted into a Digit value based on the amount of the ink ejected at a constant number of times of the ejection is used as the ink residual amount value. When the ink is ejected from the head 20, the Digit value indicative of the amount of the residual ink is gradually decreased so that a process for consuming the ink can be grasped. This processing is carried out for each of the colors of the inks accommodated in the ink cartridge 10.

The processing of calculating the amount of consumption of the ink in the flashing counter value area is carried out in the same manner. Every time the number of times of the ejection reaches a constant number of times, a predetermined value, for example, 1 Digit is subtracted from the waste liquid amount value fetched in the parameter work area. In this case, a Digit value obtained by converting the amount of the waste liquid which can be accommodated based on the amount of the ink ejected at a constant number of times of the ejection is used as the waste liquid amount value. When the flashing and the cleaning are carried out, the Digit value indicative of the amount of the waste liquid is gradually decreased.

While the processing method of subtracting the Digit value has been described, the residual amount of the ink and the amount of the waste liquid can be managed by a processing method of carrying out an addition in the same manner. Moreover, it is also possible to exactly use a capacity value by calculating an ink cartridge capacity to be 50 cc and the amount of ejection of the ink at a constant number of times of the ejection to be 0.1 cc, for example, without converting the amount of the residual ink and the amount of the waste liquid to the Digit value. Alternatively, it is also possible to use a weight value in place of the capacity value.

Thus, the data on the amount of the residual ink and the amount of the waste liquid which are processed in the parameter work area are written to the storage portion 15 in accordance with a reverse flow to the read of the data from the storage portion 15. First of all, the data processed in the parameter work area are written to the edit data area and are stored therein. At this time, a serial work for reading data from the edit data area to the parameter work area and carrying out a processing, and writing the processed data to the edit data area again always makes a set and is executed in the set at each time. The data written to the edit data area are compared with data in a raw data area and whether the data are updated is decided. If the data are updated, they are written to the storage portion 15 of the ink cartridge 10.

Referring to the data processing described above, more detailed description will be given with reference to a block diagram of FIG. 9. The storage portion 15 of the ink cartridge 10 has the ink residual amount memory portion 51 for storing the amount of the residual ink, the near-end threshold memory portion 50 for storing a near-end threshold, the waste liquid amount memory portion 61 for storing the amount of the waste liquid, and the near-full threshold memory portion 60 for storing a near-full threshold for information about the amount of containment of the ink.

When the ink cartridge 10 is attached to the printer 1, a writing/reading portion 78 of the control portion 36 in the printer 1 reads the amount of the residual ink, a near-end threshold, the amount of the waste liquid and a near-full threshold from the storage portion 15 and stores them therein. The writing/reading portion 78 corresponds to the raw data area described with reference to FIG. 8. The amount of the residual ink and the amount of the waste liquid are fetched into an ink consumption amount calculating portion 72 and a waste liquid amount calculating portion 76 which are the edit data area/parameter work area, respectively.

In order to calculate the amount of consumption of the ink ejected from the head 20, the ink consumption amount calculating portion 72 gives access to a printing control portion 70 to be a shot counter value area, a flashing control portion 73 to be a flashing counter value area, and a cleaning control portion 74 and calculates the total amount of consumption of the ink based on their own data.

The printing control portion 70 drives the heads 20*a*, 20*b*, 20*c* and 20*d* for discharging the inks having the colors through a head driving portion 71 upon receipt of a printing command from a host, thereby carrying out the printing over the paper 9. At the same time, the number of times of the ejection of the ink required for the printing is counted. The ink consumption amount calculating portion 72 calculates the number of times of the ejection as the value of the amount of consumption of the ink.

Moreover, the cleaning control portion 74 carries out cleaning for sucking the ink from the head 20 through a pump driving portion 75 after the execution of a constant printing operation. In the attachment of the ink cartridge 10, moreover, the ink is sucked in such a manner that the head 20 is filled with the ink. The ink consumption amount calculating portion 72 calculates the amount of the sucked ink from the amount of suction of the ink for one rotation of the pump 34 and the rotating speed of the pump 34. For the amount of the ink, a value obtained by converting the amount of the sucked ink into the number of times of the ejection of the ink from the head 20 is used corresponding to the calculation of the amount of consumption of the ink utilized for the printing. The cleaning can be executed upon receipt of a command from the host or can also be executed forcibly upon receipt of the command of a cleaning command portion 79 such as a button provided in the printer 1 through a detecting portion 80. The amount of consumption of the ink through the forcible cleaning is also included in the calculation of the amount of the ink sucked by the cleaning.

Furthermore, the flashing control portion 73 calculates the amount of the ink ejected by flashing carried out for the execution of the constant printing operation. The amount of consumption of the ink is calculated at the number of times of the ejection in the same manner as the printing control portion 70. The amount of the residual ink is newly calculated based on the result of each calculation for the amount of consumption of the ink used for the printing, the amount of the ink sucked by the cleaning and the amount of the ink ejected by the flashing. The amount of the residual ink which is newly calculated is written to the ink residual amount memory portion 51 of the ink cartridge 10 through the writing/reading portion 78. Thus, the ink residual amount memory portion 51 always holds the newest information about the amount of the residual ink.

The updated amount of the residual ink to be written to the ink residual amount memory portion 51 is represented in a Digit number by setting a constant number of times of the ejection to be 1 Digit. When an operation is ended, for example, a power supply is turned OFF, therefore, the processing is carried out at a fractional number of times which is less than the constant number of times of the ejection. In the case in which the fractional number of times is equal to or larger than a half of the constant number of times of the ejection, it is carried and is treated as 1 Digit. In the case in which the same fractional number of times is smaller than the half, it is discarded. Information about the fact that the fractional processing of carrying is executed is stored as a flag in the ink residual amount memory portion 51.

The waste liquid amount calculating portion 76 decides, as a waste liquid, the amount of consumption of the ink based on the calculation of the amount of the ink sucked by the cleaning and the calculation of the amount of the ink ejected by the flashing, and updates the value of the amount of the waste liquid which has already been read. The amount of the waste liquid thus updated is written to the waste liquid amount memory portion 61 of the ink cartridge 10 through the writing/reading portion 78. Thus, the waste liquid amount memory portion 61 always holds the newest information about the amount of the waste liquid.

A deciding portion 77 compares the near-end threshold read into the writing/reading portion 78 with a latest ink residual amount calculated by the ink consumption amount calculating portion 72 and decides that the amount of the residual ink runs short, that is, a near-end state is brought if the value of the amount of the residual ink reaches the near-end threshold. Then, a display of the near-end is carried out on the display portion 56 by turning on/off the lamp of an LED.

The deciding portion 77 further compares the near-full threshold read into the writing/reading portion 78 with a latest waste liquid amount obtained by a calculation for the amount of the ink sucked by the cleaning and a calculation for the amount of the ink ejected by the flashing, and decides that the waste liquid tank 11*e* is almost full of the waste liquid, that is, a near-full state is brought if the value of the amount of the waste liquid reaches the near-full threshold. Then, a display of the near-full is carried out on the display portion 56 by turning on/off the lamp of the LED. There is also a method of displaying the near-end and the near-full in an image or a character by means of a liquid crystal panel, thereby causing the user to know the same display.

Brief description will be given to the data structure of the storage portion 15 of the ink cartridge 10. Table 1 shows a part of the data structure. The storage portion 15 has the residual amounts of four kinds of inks and the amount of the waste liquid which can be absorbed as update information, and has the near-end threshold of the ink and the near-full threshold of the waste liquid as threshold information. More specifically, all peculiar information to the ink cartridge 10 are stored in the storage portion 15.

TABLE 1

| Data structure of storage portion | | | |
|---|---|---|---|
| Category | Item | Address | Size (bit) |
| Update information | Amount of residual ink | | |
| | Cyan | 0 | 13 |
| | Magenta | 13 | 13 |
| | Yellow | 26 | 13 |
| | Black | 39 | 13 |
| | Amount of waste liquid which can be absorbed | 52 | 13 |
| Threshold information | Ink near-end threshold | 99 | 5 |
| | Waste liquid near-full threshold | 104 | 5 |

Thus, the storage portion 15 of the ink cartridge 10 also has the near-end threshold in addition to the information about the amount of the residual ink. Consequently, the control portion 36 of the printer 1 does not need to hold the individual information of the attachable ink cartridge 10. Accordingly, it is preferable that the control portion 36 should carry out a general purpose processing such as the update of the amount of the residual ink, and the comparison and decision of the updated amount of the residual ink and the near-end threshold. Even if a new addition and a change in specifications of the ink cartridge 10 are carried out, it is not necessary to change the program of the control portion 36.

Moreover, the storage portion 15 of the ink cartridge 10 provided with the waste liquid storage cartridge 19 also has the near-full threshold in addition to the information about the amount of the waste liquid. Consequently, the control portion 36 of the printer 1 does not need to hold the individual information of the attachable ink cartridge 10. Accordingly, it is sufficient that the control portion 36 carries out a general purpose processing such as the update of the amount of the waste liquid, and the comparison and decision of the updated amount of the waste liquid and the near-full threshold. Even if the specifications of the waste liquid storage cartridge 19 are changed, it is not necessary to change the program of the control portion 36.

Figure 10:
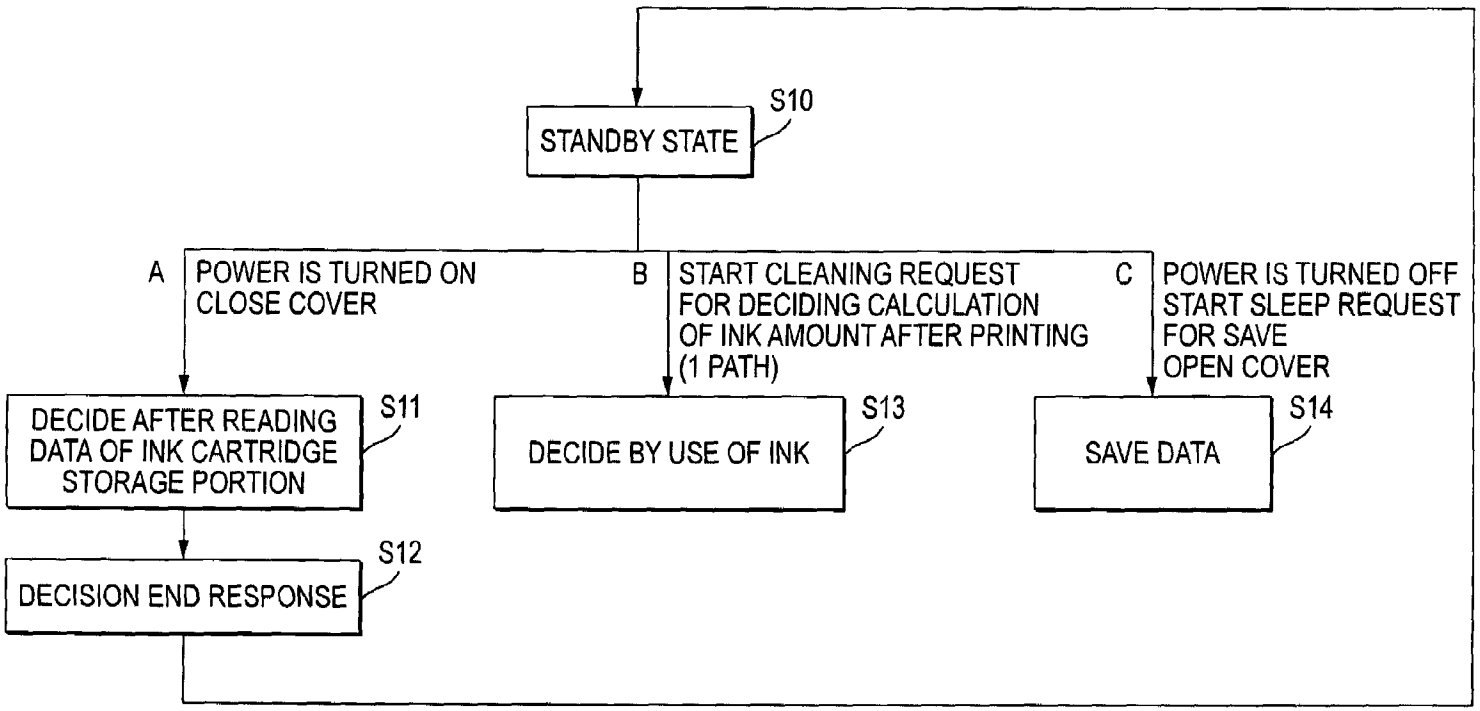
FIG. 10 is a flowchart showing the flow of a calculation processing and a data save processing in a standby state.
Figure 11:
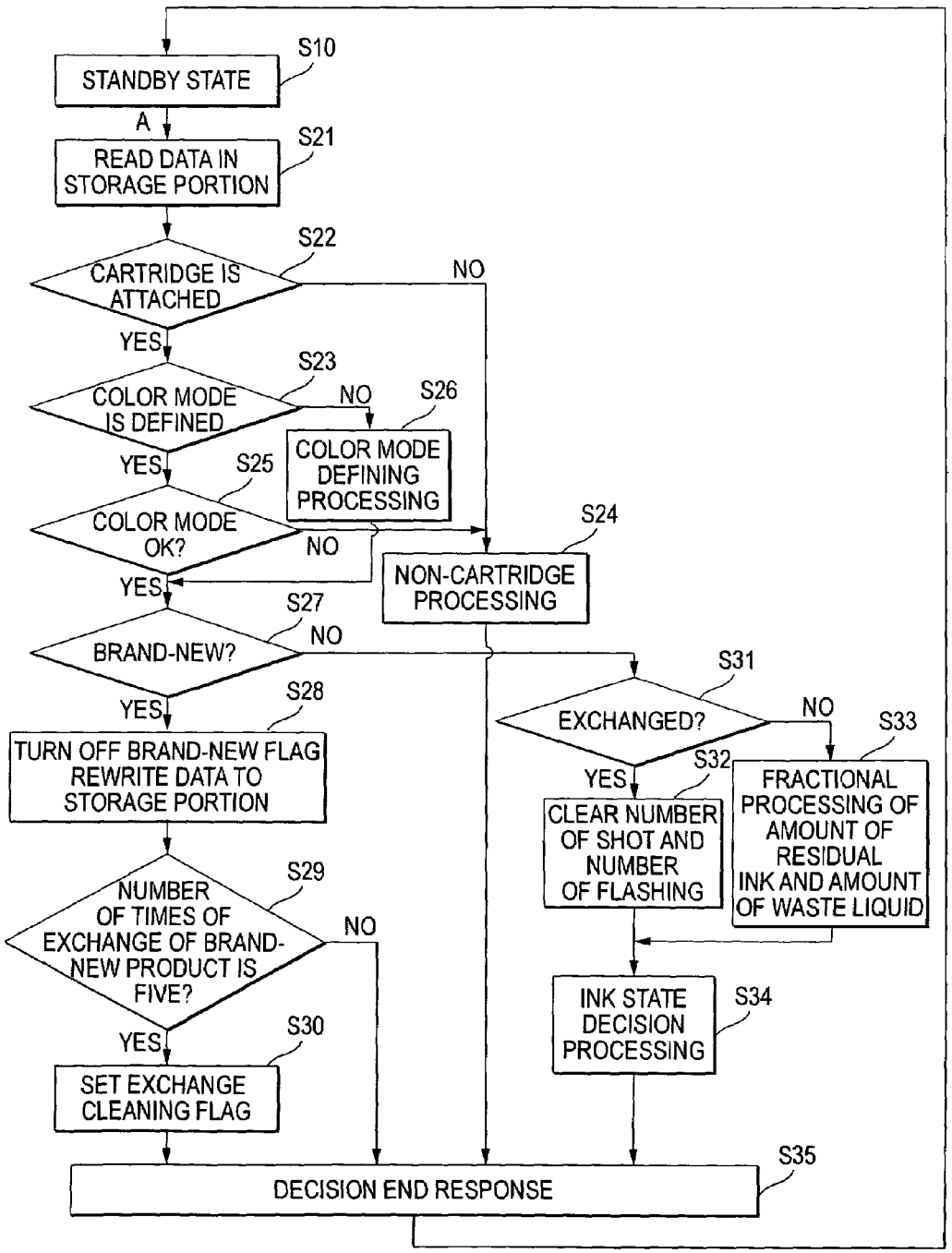
Figure 12:
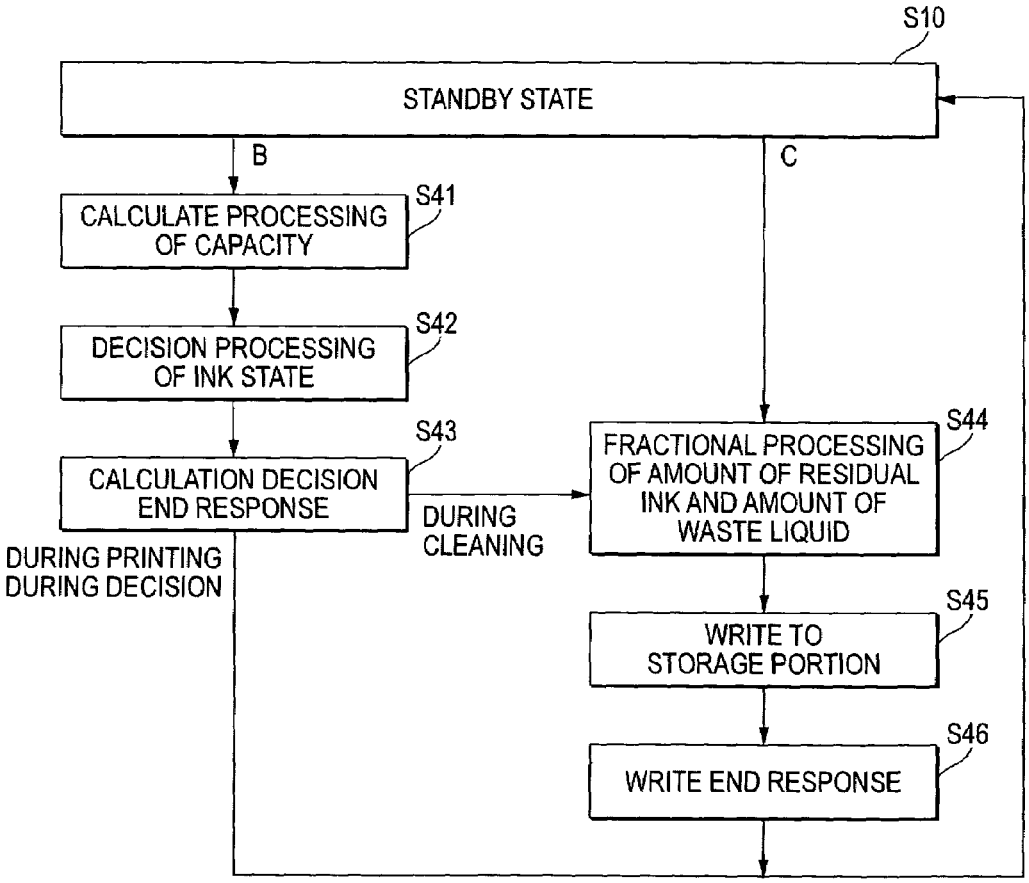
FIG. 12 is a flowchart showing the flow of the processings of calculating the amount of consumption of the ink, making a decision of near-end and writing data.

With reference to FIGS. 10, 11 and 12, next, description will be given to the flow of a processing related to the ink which is to be carried out by the printer 1 having the ink cartridge 10 attached thereto. FIG. 10 is a flowchart showing the flow of a calculation processing and a data storage processing in the standby state of the printer 1. There are three flows A, B and C. The standby state implies that the printer 1 waits for a next command in an immediate operable condition in addition to a power-OFF state. The flow A is executed when a power supply is turned ON in the standby state (step S10) or when the cover 6 opened for the exchange of the ink cartridge 10 is closed so that a cover close state is brought in the standby state of power-ON, and data are read from the storage portion 15 of the ink cartridge 10 to carry out various decision processings (S11). When the decision processings are ended, a response is given corresponding to the result of the decision (S12) and the standby state is then returned.

The flow B is executed immediately before the cleaning is started, after printing for one pass is ended, and when the amount of the ink is calculated and a decision is demanded, and the amount of the residual ink is calculated and the state of the ink is decided (S13), and then, the standby state is returned.

The flow C is executed when a power OFF command is input, when a sleep in a power saving stop state is started, when a request for saving data is given and when the cover is opened, and the data are saved in the storage portion 15 of the ink cartridge 10 (S14).

The flow A will be first described in detail with reference to FIG. 11. In the standby state (S10), first of all, data in the storage portion 15 are read into the writing/reading portion 78 (S21), and the following decision is made by the deciding portion 77. The presence of the ink cartridge 10 is first decided (S22). If the ink cartridge 10 is present, it is decided whether or not the color mode of an ink to be used by the printer 1 is defined (S23). If the cover is closed without attaching the ink cartridge 10 or the data of the ink cartridge 10 cannot be read, it is decided that the ink cartridge 10 is not present and the processing is carried out (S24). If the color mode is defined at the step S23, it is decided whether or not the color mode of the printer 1 is coincident with that of the ink cartridge 10 (S25). If the color mode is not defined, the color mode of the printer 1 is set to be that of the ink cartridge 10 which is attached (S26) and the processing proceeds to a step S27.

If the color mode of the printer 1 is coincident with that of the ink cartridge 10 at the step S25, it is decided whether or not the ink carriage 10 is brand-new (S27). If the color modes are not coincident with each other at the step S25, it is decided that the ink cartridge 10 is not present and the processing is carried out (S24). If it is decided that the ink cartridge 10 is brand-new at the step S27, the brand-new flag of the ink cartridge 10 is turned OFF in such a manner that the decision of "brand-new" is not made when reattachment is carried out next time, and the data of the storage portion 15 are rewritten (S28). At the same time, a processing of increasing the number of times of a brand-new exchange counter on the printer 1 side by one is carried out and it is then decided whether or not the number of times of the brand-new exchange reaches five (S29). If the number of times reaches five, an exchange cleaning flag is set to give a cleaning start command. Thereafter, the number of times of the brand-new exchange counter on the printer 1 side is cleared (S30) and a decision end response is given (S35). If the number of times does not reach five, the decision end response is given (S35).

When it is decided that the ink cartridge 10 is not brand-new at the step S27, it is decided whether the ink cartridge 10 is the same as the ink cartridge 10 attached last time or is exchanged (S31). If the ink cartridge 10 is exchanged, the numbers of times of ejection (the numbers of shots) in the printing control portion 70 and the flashing control portion 73, and the number of times of the ejection of flashing including cleaning are cleared and are replaced with the amount of the residual ink in the ink cartridge 10. At the same time, the near-end threshold of the control portion 36 is also replaced (S32). If the ink cartridge 10 is not exchanged, the flag of a fractional processing written to the ink cartridge 10 is recognized. If a carry fractional processing is performed, a flag set is cleared (S33). At the steps S32 and S33, the amount of the waste liquid and the near-full threshold as well as the amount of the residual ink are processed in the same manner. After the step S32 or S33, it is decided whether or not the amount of the residual ink reaches the near-end threshold or the amount of the waste liquid reaches the near-full threshold. If the threshold is reached, an instruction for displaying "near-end" and "near-full" is given (S34) and the decision end response is given (S35). After the decision end response is given, the standby state is returned.

By the flow A described above, the information about the ink such as the amount of the residual ink in the ink cartridge 10 which is attached or the amount of the waste liquid can be recognized correctly. Consequently, it is possible to prevent a hindrance such as the shortage of the ink in the middle of printing or the overflow of the waste liquid. All of the information about the ink are stored in the ink cartridge 10 and the printer 1 does not need to have information.

With reference to FIG. 12, next, the flows B and C will be described. The flow B carries out the confirmation of the amount of the residual ink which is necessary for performing cleaning, the calculation of the amount of the ink consumed after the end of printing for one pass, the confirmation of the contents of a decision request, and the calculation of the amount of the ink to be the waste liquid in the amount of consumption of the ink in a capacity calculation processing at a step S41. Then, the amount of the residual ink is newly calculated in the ink consumption amount calculating portion 72 and the amount of the waste liquid is newly calculated in the waste liquid amount calculating portion 76. Subsequently, the amount of the residual ink and the amount of the waste liquid which are calculated in the capacity calculation processing at the step S41 are compared with the near-end threshold and the near-full threshold respectively in an ink state decision processing at a step S42, and the ink state is thus decided. Based on the result of the decision, a response that the amount of the residual ink is set in a near-end state or not and the amount of the waste liquid is set in a near-full state or a normal state is given in a calculation and decision end response at a step S43.

After the step S43, the printing is continuously carried out through the standby state in case of the calculation of the amount of the ink after the end of the printing for one pass, and the standby state is returned in case of a request for a decision. In case of the cleaning, the cleaning is executed and the processing proceeds to the flow C. If it is decided that the near-end or near-full state is decided, the state is displayed on the display portion 56.

In the flow C, a fractional number of times which is less than a constant number of times of the ejection in the numbers of times of the ejection counted by the printing control portion 70, the flashing control portion 73 and the cleaning control portion 74 respectively is processed in a fractional processing for the amount of the residual ink and the amount of the waste liquid at a step S44. If the fractional number of times is equal to or larger than a half of the constant number of times of the ejection, a carry is performed as 1 Digit. If the fractional number of times is smaller than the half, the ink consumption amount calculating portion 72 executes a discard processing, thereby calculating the amount of the residual amount. The waste liquid amount calculating portion 76 carries out the processing for the fractional numbers of times in the flashing control portion 73 and the cleaning control portion 74 for the waste liquid, thereby calculating the amount of the waste liquid.

The amount of the residual ink and the amount of the waste liquid which are subjected to the fractional processing are written to the storage portion 15 of the ink cartridge 10 through the writing/reading portion 78 (S45). When writing is normally carried out, a write end response is given to a command source (S46) and the standby state is returned so that a designated power OFF state is brought. The processing related to the ink is executed in the flow described above.

Finally, the advantages of the liquid cartridge, the printer and the method of controlling the printer will be collectively described.

(1) The ink cartridge 10 stores the amount of the residual ink in the ink cartridge 10 and the near-end threshold indicating, in the volume of the ink, that the ink runs short and the housing portion 11 is almost empty. Consequently, the printer 1 does not need to hold the individual information of the ink cartridge 10 which can be attached.

(2) The waste liquid storage cartridge 19 stores the amount of the waste liquid in the waste liquid storage cartridge 19 and the near-full threshold indicating, in the volume of the housing portion 11, that the housing portion 11 is almost full of the waste liquid. Consequently, the printer 1 does not need to hold the individual information of the waste liquid storage cartridge 19 which can be attached.

(3) It is sufficient that the printer 1 can execute general purpose processings such as a data read and write, and a comparison and decision. It is not necessary to change a version corresponding to a variation in the specifications of the ink cartridge 10. Even if the ink cartridge having new specifications is exchanged or attached, accordingly, information about the ink is read from the ink cartridge 10 so that reliable information about "near-end" can be displayed.

(4) It is sufficient that the printer 1 can execute the general purpose processings such as a data read and write, and a comparison and decision. It is not necessary to change a version corresponding to a variation in the specifications of the waste liquid storage cartridge 19. Even if the waste liquid storage cartridge having new specifications is exchanged or attached, accordingly, information about the waste liquid is read from the waste liquid storage cartridge 19 so that reliable information about "near-full" can be displayed.

(5) A flash memory is used for the storage portion 15 in the ink cartridge 10 and the waste liquid storage cartridge 19, and a read/write can be carried out instantaneously. Even if the information about the ink and the information about the waste liquid are updated at any time, therefore, a load applied to the printer 1 is reduced.

(6) The newest information about the ink is updated and saved in the ink cartridge 10 at any time. Therefore, the information about the ink can be held in the ink cartridge 10 without depending on the state of the printer 1 against the abnormal breaking of a power supply in the printer 1.

(7) The newest information about the waste liquid is updated and saved in the waste liquid storage cartridge 19 at any time. Therefore, the information about the waste liquid can be held in the waste liquid storage cartridge 19 without depending on the state of the printer 1 against the abnormal breaking of the power supply in the printer 1.

(8) Also in the case in which the ink cartridge 10 does not accommodate inks having a plurality of colors in an integral ink cartridge but a single separate ink cartridge, it is possible to provide the storage portion 15 in the single ink cartridge, thereby confirming the near-end in the same manner as in the integral ink cartridge.

(9) The waste liquid storage cartridge 19 has such a structure as to be integrated with the ink tank for accommodating the ink to be used for the printing, and a removing/attaching operation can easily be carried out. Because of the integral structure, moreover, it is sufficient that all of the information about a waste liquid and an ink are stored in the storage portion 15, and the storage portion does not need to be provided for the waste liquid and the ink individually.

(10) The amount of consumption of the ink is calculated for each purpose from the amount of the ink used for the printing and the amount of the ink used for the flashing and the cleaning in the capping portion 35. Consequently, the amount of the ink can be managed minutely.

(11) The amount of the ink to be the waste liquid used for the flashing and the cleaning in the capping portion 35 and the amount of the ink used for the printing are calculated for each purpose. Consequently, the amount of the ink can be managed minutely.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2004-013206 filed on Jan. 21, 2004 and Japan Patent Application No. 2004-017253 filed on Jan. 26, 2004, the contents of which are incorporated herein for reference.

What is claimed is:

1. A printer, comprising:

a head, which ejects a liquid;

a liquid cartridge, which includes:

an ink cartridge, which has a first housing portion for containing the liquid therein to be ejected from the head to a printing medium for printing;

a waste liquid storage cartridge, which has a second housing portion for containing a waste liquid which is not used for the printing; and a rewritable nonvolatile storage portion, which stores a first threshold, a second threshold, liquid amount information and waste liquid amount information;

a writing/reading portion, which reads the first and second thresholds, the liquid amount information and the waste liquid amount information from the storage portion; and a determinant, which judges both whether a liquid amount of the liquid amount information read from the storage portion reaches the first threshold and whether a waste liquid amount of the waste liquid amount information read from the storage portion reaches the second threshold; and a notifier, which notifies a life time of the liquid cartridge when either one of the two judgments is judged by the determinant, wherein the first threshold indicates a near liquid end state in which the liquid in the first housing portion is near to end;

wherein the second threshold indicates a near full state in which the waste liquid in the second housing portion is near to full;

wherein the liquid amount information indicates the liquid amount of the liquid contained in the first housing portion;

wherein the waste liquid amount information indicates the waste liquid amount of the waste liquid contained in the second housing portion; and wherein the ink cartridge and the waste liquid cartridge are integrally formed.

2. The printer as set forth in claim 1, further comprising:

a consumed liquid calculating portion, which updates the liquid amount information based on a consumed liquid amount of the liquid in the first housing portion and the liquid amount information which is read by the writing/reading portion; and a waste liquid amount calculating portion, which updates the waste liquid amount information based on a waste liquid amount of the waste liquid corresponding to a part of the consumed liquid amount and the waste liquid amount information which is read by the writing/reading portion, wherein the writing/reading portion writes the updated liquid amount information and the updated waste liquid amount information to the storage portion.

3. The printer as set forth in claim 2, wherein the consumed liquid calculating portion calculates the consumed liquid amount of the liquid in the first housing portion based on:

a calculation for calculating a first liquid ejection amount of the liquid ejected from the head for the printing;

a calculation for calculating a first liquid suction amount of the liquid sucked from the head in an attachment of the ink cartridge and a second liquid suction amount of the liquid sucked in cleaning of the head;

a calculation for calculating a second liquid ejection amount of the liquid ejected in flashing in which the liquid is ejected to a predetermined portion other than the printing medium for preventing the head from being clogged in the printing; and a calculation for calculating the latest liquid amount contained in the first housing portion based on the first and second liquid ejection amounts and the first and second suction amounts in accordance with results of the calculations.

4. The printer as set forth in claim 2, wherein the waste liquid amount calculating portion calculates the waste liquid amount based on:

a calculation for calculating a first liquid suction amount of the liquid sucked from the head in an attachment of the ink cartridge;

a calculation for calculating a second liquid suction amount of the liquid sucked in cleaning of the head;

a calculation for calculating a liquid ejection amount of the liquid ejected in flashing in which the liquid is ejected to a predetermined portion other than the printing medium for preventing the head from being clogged in the printing; and a calculation for calculating the latest waste liquid amount contained in the second housing portion based on the liquid ejection amount and the first and second suction amounts in accordance with results of the calculations.

5. The printer as set forth in claim 2, further comprising an attaching portion, wherein when the liquid cartridge is attached to the attaching portion, the storage portion is electrically conducted to the writing/reading portion;

wherein the consumed liquid calculating portion updates the liquid amount information every time when the liquid amount of the liquid in the first housing portion is changed; and wherein the waste liquid amount calculating portion updates the waste liquid amount information every time when the waste liquid amount of the waste liquid in the second housing portion is changed.

6. A method for controlling a printer, comprising:

reading a first threshold regarding a liquid and a second threshold regarding a waste liquid from a rewritable nonvolatile storage portion of a liquid cartridge, the liquid cartridge including an ink cartridge which has a first housing portion for containing the liquid to be ejected from a head and a waste liquid storage cartridge which has a second housing portion for containing the waste liquid which is not used for the printing;

judging whether a liquid amount of the liquid contained in the first housing portion reaches the first threshold;

judging whether a waste liquid amount of the waste liquid contained in the second housing portion reaches the second threshold; and notifying a life time of the liquid cartridge when either one of the judging step of the liquid amount and the judging step of the waste liquid amount is a positive result, wherein the first threshold indicates a near liquid end state in which the liquid in the first housing portion is near to end; and wherein the second threshold indicates a near full state in which the waste liquid in the second housing portion is near to full.

7. The method as set forth in claim 6, further comprising:

reading liquid amount information about the liquid amount of the liquid in the first portion from the storage portion;

calculating a consumed liquid amount of the liquid in the first housing portion:

updating the liquid amount information based on the consumed liquid amount and the read liquid amount information; and writing the updated liquid amount information to the storage portion.

8. The method as set forth in claim 7, wherein the calculating function of the consumed liquid amount of the liquid in the first housing portion includes:

calculating a first liquid ejection amount of the liquid ejected from the head for the printing;

calculating a first liquid suction amount of the liquid sucked from the head in an attachment of the ink cartridge and a second liquid suction amount of the liquid sucked in cleaning of the head;

calculating a second liquid ejection amount of the liquid ejected in flashing in which the liquid is ejected to a predetermined portion other than the printing medium for preventing the head from being clogged in the printing; and calculating the latest liquid amount contained in the first housing portion based on the first and second liquid ejection amounts and the first and second suction amounts in accordance with results of the calculating functions.

9. The method as set forth in claim 6, further comprising:

reading waste liquid amount information about the waste liquid amount of the waste liquid in the second portion from the storage portion;

calculating a consumed waste liquid amount of the waste liquid corresponding to a part of the consumed liquid amount;

updating the waste liquid amount information based on the consumed waste liquid amount and the read waste liquid amount information; and writing the updated waste liquid amount information to the storage portion.

10. The method as set forth in claim 9, wherein the calculating function of the consumed waste liquid amount of the waste liquid in the second housing portion includes:

calculating a first liquid suction amount of the liquid sucked from the head in an attachment of the ink cartridge;

calculating a second liquid suction amount of the liquid sucked in cleaning of the head;

calculating a liquid ejection amount of the liquid ejected in flashing in which the liquid is ejected to a predetermined portion other than the printing medium for preventing the head from being clogged in the printing; and calculating the latest waste liquid amount contained in the second housing portion based on the liquid ejection amount and the first and second suction amounts in accordance with results of the calculating functions.

11. A liquid cartridge, comprising:

an ink cartridge, which has a first housing portion for containing a liquid therein for supplying the liquid to an apparatus;

a waste liquid storage cartridge, which has a second housing portion for containing a waste liquid to be supplied from the apparatus; and a rewritable nonvolatile storage portion, which stores a first threshold, a second threshold, liquid amount information and waste liquid amount information, wherein the first threshold indicates a near liquid end state in which the liquid in the first housing portion is near to end;

wherein the second threshold indicates a near full state in which the waste liquid in the second housing portion is near to full;

wherein the liquid amount information indicates a liquid amount of the liquid contained in the first housing portion;

wherein the waste liquid amount information indicates a waste liquid amount of the waste liquid contained in the second housing portion;

wherein the ink cartridge and the waste liquid cartridge are integrally formed; and wherein the rewritable non-volatile storage portion defines (1) means for a determinant to judge both whether a liquid amount of the liquid amount information reaches the first threshold and whether a waste liquid amount of the waste liquid amount information reaches the second threshold and (2) means for a notifier to notify a life time of the liquid cartridge when either one of the two judgments is judged by the determinant.

12. The liquid cartridge as set forth in claim 11, wherein the storage portion is electrically conducted to the apparatus when the liquid cartridge is attached to the apparatus;

wherein the liquid amount information, the waste liquid amount information and the first and second thresholds stored in the storage portion are transmitted to the apparatus;

wherein the liquid amount information stored in the storage portion is updated by the apparatus every time when the liquid amount of the liquid contained in the first housing portion is changed; and wherein the waste liquid amount information stored in the storage portion is updated by the apparatus every time when the waste liquid amount of the waste liquid contained in the second housing portion is changed.

13. A liquid cartridge, configured to be detachably attached to an apparatus, comprising:

a first container, configured to contain liquid to be supplied to the apparatus;

a second container, configured to contain waste liquid supplied from the apparatus; and a storage, operable to store a first threshold value indicative of a first state in which the liquid in the first container is near to end and a second threshold value indicative of a second state in which the waste liquid in the second container is near to full, wherein the storage defines (1) means for a determinant to judge both whether a liquid amount reaches the first threshold and whether a waste liquid amount reaches the second threshold and (2) means for a notifier to notify a life time of the liquid cartridge when either one of the two judgments is judged by the determinant.

14. The liquid cartridge as set forth in claim 13, wherein:

the storage is configured to be electrically connected to the apparatus when the liquid cartridge is attached to the apparatus, so that the first threshold value and the second threshold value are transmittable to the apparatus.

15. The liquid cartridge as set forth in claim 13, wherein:

at least one of the first threshold value and the second threshold value is rewritable.

16. A liquid cartridge, configured to be detachably attached to an apparatus, comprising:

a first container, configured to contain liquid to be supplied to the apparatus;

a second container, configured to contain waste liquid supplied from the apparatus; and a storage, operable to store a first threshold value indicative of a first state in which the liquid in the first container is near to end and a second threshold value indicative of a second state in which the waste liquid in the second container is near to full, the storage being configured to communicate with a determinant in the apparatus to judge both whether a liquid amount reaches the first threshold and whether a waste liquid amount reaches the second threshold, and with a notifier in the apparatus to notify a life time of the liquid cartridge when either one of the two judgments is judged by the determinant.

* * * * *